US010779661B2

(12) United States Patent
Schoening et al.

(10) Patent No.: US 10,779,661 B2
(45) Date of Patent: Sep. 22, 2020

(54) UTENSIL DISPENSERS WITH GLIDE MECHANISM FOR LOADING

(71) Applicant: GPCP IP Holdings LLC, Atlanta, GA (US)

(72) Inventors: Mark Edward Schoening, Portland, OR (US); Randy C. Karambelas, Milwaukie, OR (US); Tod Alan Kinsley, Keizer, OR (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 16/226,863

(22) Filed: Dec. 20, 2018

(65) Prior Publication Data

US 2019/0223624 A1 Jul. 25, 2019

Related U.S. Application Data

(60) Provisional application No. 62/621,509, filed on Jan. 24, 2018.

(51) Int. Cl.
*A47F 1/10* (2006.01)
*A47F 5/00* (2006.01)

(52) U.S. Cl.
CPC ..... *A47F 1/10* (2013.01); *A47F 5/0037* (2013.01); *A47F 2001/103* (2013.01)

(58) Field of Classification Search
CPC .... B65D 83/04; A47F 2001/103; A47F 1/106; A47F 1/10; A47F 1/04
See application file for complete search history.

(56) References Cited

U.S. PATENT DOCUMENTS

| | | | |
|---|---|---|---|
| 592,105 | A | 10/1897 | Barnes |
| 716,058 | A | 12/1902 | Laing et al. |
| 925,485 | A | 6/1909 | Lafler |
| 999,837 | A | 8/1911 | Morris et al. |
| 1,146,447 | A | 7/1915 | Prommel |

(Continued)

FOREIGN PATENT DOCUMENTS

| | | | |
|---|---|---|---|
| CA | 2545745 | A1 | 11/2006 |
| CA | 3020168 | A1 | 10/2017 |

(Continued)

OTHER PUBLICATIONS

International Search Report and Written Opinion for PCT/US07/83752, dated Mar. 11, 2008.
International Search Report and Written Opinion for PCT/US2007/083922, dated Nov. 17, 2008.
International Search Report and Written Opinion for PCT/US2009/059915, dated Feb. 3, 2010.

(Continued)

*Primary Examiner* — Gene O Crawford
*Assistant Examiner* — Ayodeji T Ojofeitimi

(57) ABSTRACT

Utensil dispensers and methods for making and using same. In some examples, the utensil dispensers can include a housing. A dispense chassis can be configured to fit within the housing. At least one post can be disposed on an outer surface of the dispense chassis, and at least one glide mechanism can be disposed within the housing. The glide mechanism is configured to engage the dispense chassis post. The glide mechanism can include a slot configured to guide the dispense chassis between a dispensing position in which the dispense chassis is configured to dispense utensils from the housing and a loading position in which the dispense chassis is configured to be loaded with utensils.

20 Claims, 24 Drawing Sheets

(56) References Cited

U.S. PATENT DOCUMENTS 1,182,793 A 5/1916 Richardson
1,259,927 A 3/1918 Swift
1,355,583 A 10/1920 Zeidler et al.
1,482,071 A 1/1924 Duff et al.
1,504,098 A 8/1924 Cathey
1,546,077 A 7/1925 Hunter et al.
1,547,151 A 7/1925 Watling
1,577,302 A 3/1926 Edward
1,610,001 A 12/1926 Foster
1,675,510 A 7/1928 Nolan
1,767,634 A 6/1930 Weiss
1,886,378 A 11/1932 George
2,053,828 A 9/1936 Harper
2,078,984 A 5/1937 Williamson
2,110,189 A 3/1938 Zeidler
2,141,684 A 12/1938 Diemer
2,149,098 A 2/1939 Phinney
2,149,099 A 2/1939 Phinney et al.
2,188,573 A 1/1940 Longo
2,207,528 A 7/1940 Witt
2,239,196 A 4/1941 Lunvik
2,268,596 A 1/1942 Jerum
2,268,873 A 1/1942 Hopskins et al.
2,340,561 A * 2/1944 Renfro ..... A47F 1/08 312/42
2,421,782 A 6/1947 Gibbs et al.
2,427,321 A 9/1947 Casey et al.
2,472,051 A 5/1949 Testi
2,560,327 A 7/1951 Bergman
2,571,668 A 10/1951 Booth et al.
2,577,344 A 12/1951 Masure
2,635,025 A 4/1953 Ziska
2,646,874 A 7/1953 Testi
2,692,691 A 10/1954 Harriss et al.
2,868,344 A 1/1959 Sheilds
2,877,926 A 3/1959 Abbe
2,880,907 A 4/1959 Mainers
2,911,127 A 11/1959 Driss et al.
2,924,357 A 2/1960 Kingsley et al.
2,925,307 A 2/1960 Stoner
2,954,948 A 10/1960 Johnson
2,965,262 A 12/1960 Dubois et al.
3,028,048 A 4/1962 Klammer
3,054,528 A 9/1962 Loomis
3,095,114 A 6/1963 Tobias
3,114,475 A 12/1963 Etes
3,132,765 A 5/1964 Florendo
3,146,908 A 9/1964 Perri et al.
3,163,327 A 12/1964 Maxwell
3,191,802 A 6/1965 Lasting
3,248,156 A 4/1966 Repko
3,263,860 A 8/1966 Haas
3,300,087 A 1/1967 Kuypers
3,313,452 A 4/1967 Katz
3,371,821 A 3/1968 Abood, Jr.
3,428,215 A 2/1969 Wells
3,558,006 A 1/1971 Redmond et al.
3,587,922 A 6/1971 Oriti
3,680,736 A 8/1972 Viessmann
3,747,803 A 7/1973 Zoepf et al.
3,786,959 A 1/1974 Greb
4,134,519 A * 1/1979 Barnett ..... A47F 1/08 221/155
4,271,978 A 6/1981 Cottrell
4,308,974 A 1/1982 Jones
4,489,854 A 12/1984 Wenkman et al.
4,530,445 A 7/1985 Decker
4,896,792 A 1/1990 Marchand
5,127,546 A 7/1992 Chen
5,131,565 A 7/1992 Lilly
5,191,997 A 3/1993 Squitieri
5,246,138 A 9/1993 Blevins, Jr.
5,249,705 A 10/1993 Gates
5,263,596 A 11/1993 Williams
5,509,522 A 4/1996 Laidlaw
5,586,685 A 12/1996 Dorner et al.
5,921,408 A 7/1999 Groenewold et al.
6,250,498 B1 6/2001 Lovejoy
6,336,568 B1 * 1/2002 Tucker ..... A47F 1/10 221/131
D461,663 S 8/2002 Tucker et al.
6,651,841 B2 11/2003 Tsuchida
6,832,694 B2 12/2004 Goeking et al.
6,837,028 B1 1/2005 Miano et al.
6,945,427 B2 9/2005 Hieb
6,976,348 B1 12/2005 Miano et al.
7,076,932 B2 7/2006 Rubin
7,210,279 B1 5/2007 Ahmed et al.
7,322,172 B2 1/2008 Hoffman et al.
7,412,808 B2 8/2008 Lavi
D584,084 S 1/2009 Tucker
7,520,247 B2 4/2009 Rutledge
D607,245 S 1/2010 Tucker
8,070,013 B2 12/2011 Reinsel et al.
8,152,004 B2 4/2012 Smith et al.
8,210,364 B2 7/2012 Smith et al.
8,272,533 B1 * 9/2012 D'Amelia ..... A47F 1/10 221/172
8,297,473 B2 10/2012 Smith
8,360,273 B2 1/2013 Reinsel et al.
9,049,948 B2 6/2015 Jongen et al.
9,113,729 B2 8/2015 Righetti et al.
9,226,598 B1 1/2016 Knope et al.
9,700,153 B2 7/2017 Snyder et al.
10,051,976 B2 8/2018 Smith
10,413,089 B2 * 9/2019 Rajasekaran ..... A47F 1/085
2002/0112445 A1 8/2002 Scaduto
2004/0000559 A1 1/2004 Bauman
2004/0089670 A1 * 5/2004 Goeking ..... A47F 1/10 221/123
2005/0082307 A1 4/2005 Tucker
2007/0108141 A1 5/2007 Smith et al.
2007/0131705 A1 6/2007 Behravesh et al.
2007/0193968 A1 8/2007 Smith et al.
2008/0121650 A1 * 5/2008 Smith ..... A47F 1/10 221/129
2008/0128445 A1 6/2008 Huang et al.
2010/0084418 A1 * 4/2010 Reinsel ..... A47F 1/10 221/1
2010/0170915 A1 * 7/2010 Reinsel ..... A47F 1/10 221/279
2011/0180562 A1 7/2011 Reinsel et al.
2011/0226797 A1 * 9/2011 Reinsel ..... A47F 1/10 221/97
2012/0080444 A1 4/2012 Smith et al.
2012/0145734 A1 * 6/2012 Walters ..... A47F 1/10 221/1
2012/0145735 A1 * 6/2012 Erickson ..... A47F 1/10 221/1
2012/0145736 A1 * 6/2012 Walters ..... A47F 1/10 221/1
2013/0032609 A1 2/2013 Righetti et al.
2013/0043272 A1 * 2/2013 Oakes ..... A47F 1/125 221/279
2013/0193157 A1 * 8/2013 Jongen ..... A47F 1/08 221/23
2014/0117036 A1 * 5/2014 Smith ..... A47F 1/10 221/1
2015/0001235 A9 1/2015 Smith
2015/0028045 A1 * 1/2015 Oakes ..... B65D 75/42 221/1
2015/0041484 A1 * 2/2015 Oakes ..... A47F 1/126 221/1
2015/0048108 A1 * 2/2015 Borke ..... B65D 73/02 221/195
2015/0289679 A1 * 10/2015 Oakes ..... A47F 1/125 221/1
2016/0242569 A1 * 8/2016 Snyder ..... A47F 1/04
2017/0354270 A1 12/2017 Oakes
2019/0075940 A1 3/2019 Pierson et al.

(56) References Cited

U.S. PATENT DOCUMENTS

| | | | |
|---|---|---|---|
| 2019/0125112 | A1 | 5/2019 | Mithal et al. |
| 2020/0093281 | A1 | 3/2020 | Goltz |

FOREIGN PATENT DOCUMENTS

| | | | |
|---|---|---|---|
| CA | 3021819 | A1 | 11/2018 |
| CN | 2865478 | Y | 2/2007 |
| CN | 101066183 | A | 11/2007 |
| CN | 103919421 | A | 7/2014 |
| CN | 203828595 | U | 9/2014 |
| CN | 103919422 | B | 7/2015 |
| CN | 103960919 | B | 2/2017 |
| EP | 0662295 | A1 | 7/1995 |
| EP | 0856272 | A2 | 8/1998 |
| EP | 1213985 | A1 | 6/2002 |
| EP | 1217923 | A1 | 7/2002 |
| EP | 1719438 | A1 | 11/2006 |
| EP | 1864596 | A2 | 12/2007 |
| FR | 2889507 | A1 | 2/2007 |
| KR | 100954569 | B1 | 4/2010 |
| PL | 200112 | A1 | 12/2008 |
| TW | M287639 | U | 2/2006 |
| TW | M293720 | U | 7/2006 |
| WO | 0105281 | A | 1/2001 |
| WO | 2001005280 | A1 | 1/2001 |
| WO | 2001068492 | | 9/2001 |
| WO | 2004028309 | A1 | 4/2004 |
| WO | 2008058187 | A2 | 5/2008 |
| WO | 2016155644 | A1 | 10/2016 |
| WO | 2017139525 | A1 | 8/2017 |
| WO | 2017139527 | A1 | 8/2017 |
| WO | 2018006062 | A1 | 1/2018 |

OTHER PUBLICATIONS

International Search Report and Written Opinion for PCT/US2011/058767 dated Feb. 29, 2012.

International Search Report and Written Opinion for PCT/US2011/064057 dated Feb. 29, 2012.

International Search Report and Written Opinion for PCT/US2011/058329 dated Feb. 29, 2012.

International Search Report and Written Opinion for PCT/US2010/000051, dated Aug. 16, 2010.

International Search Report and Written Opinion for PCT/US2014/050166, dated Nov. 20, 2014.

International Search Report and Written Opinion for PCT/US2014/050169, dated Jan. 9, 2015.

International Search Report and Written Opinion for PCT/US2017/037233, dated Sep. 5, 2017.

International Search Report and Written Opinion for International Application No. PCT/US2013/022455, mailed by the International Searching Authority dated May 30, 2013.

International Search Report and Written Opinion for International Application No. PCT/US2019/014137 dated 6, 2019.

European Search Report for 06009258.2, dated Jul. 24, 2006.

European Search Report for EP 08 014 387.8, dated Nov. 11, 2008.

International Search Report and Written Opinion for PCT/US2014/051639, dated Dec. 9, 2014.

Supplementary European Search Report dated Sep. 25, 2013 for Application No. 11793088.3.

International Search Report and Written Opinion received for PCT patent application No. PCT/US2019/014163, dated Apr. 1, 2019, 11 pages.

International Search Report and Written Opinion received for PCT patent application No. PCT/US2019/014165, dated Apr. 1, 2019, 10 pages.

* cited by examiner

UTENSIL DISPENSERS WITH GLIDE MECHANISM FOR LOADING

CROSS REFERENCE TO RELATED APPLICATIONS

This application claims priority to U.S. Provisional Application No. 62/621,509, filed Jan. 24, 2018, and entitled "UTENSIL DISPENSERS WITH GLIDE MECHANISM FOR LOADING", which is hereby incorporated by reference in its entirety.

BACKGROUND

Field

Embodiments described generally relate to utensil dispensers and methods for making and using same. More particularly, embodiments described relate to utensil dispensers having a glide mechanism for loading, as well as methods for making and using same.

Description of the Related Art

Disposable utensils can typically be found in fast-food and take out restaurants. Such restaurants allow consumers the ability to select various types of utensils that they wish to use by taking the utensils from a publicly accessible dispenser or bin. Conventional utensil dispensers have been used to provide a confined and controlled protective environment for utensils housed within. Such assemblies, however, have challenges and issues delivering utensils to a consumer in a repeatable and reliable manner. Conventional assemblies can also have difficulties associated with loading utensils and with maintaining a reliable supply of utensils for customers.

There is a need, therefore, for a cutlery dispenser that can supply utensils to customers in a reliable and sanitary manner.

SUMMARY

Utensil dispensers and methods for making and using same are provided herein. In some examples, the utensil dispensers can include a housing, a dispense chassis configured to fit within the housing, at least one post disposed on an outer surface of the dispense chassis, at least one glide mechanism disposed within the housing and configured to engage the dispense chassis post within the housing, the glide mechanism can include a slot configured to contact the post of the dispense chassis and/or to guide the dispense chassis between a dispensing position in which the dispense chassis is configured to dispense utensils from the housing and a loading position in which the dispense chassis is configured to be loaded with utensils.

DETAILED DESCRIPTION

Figure 1:
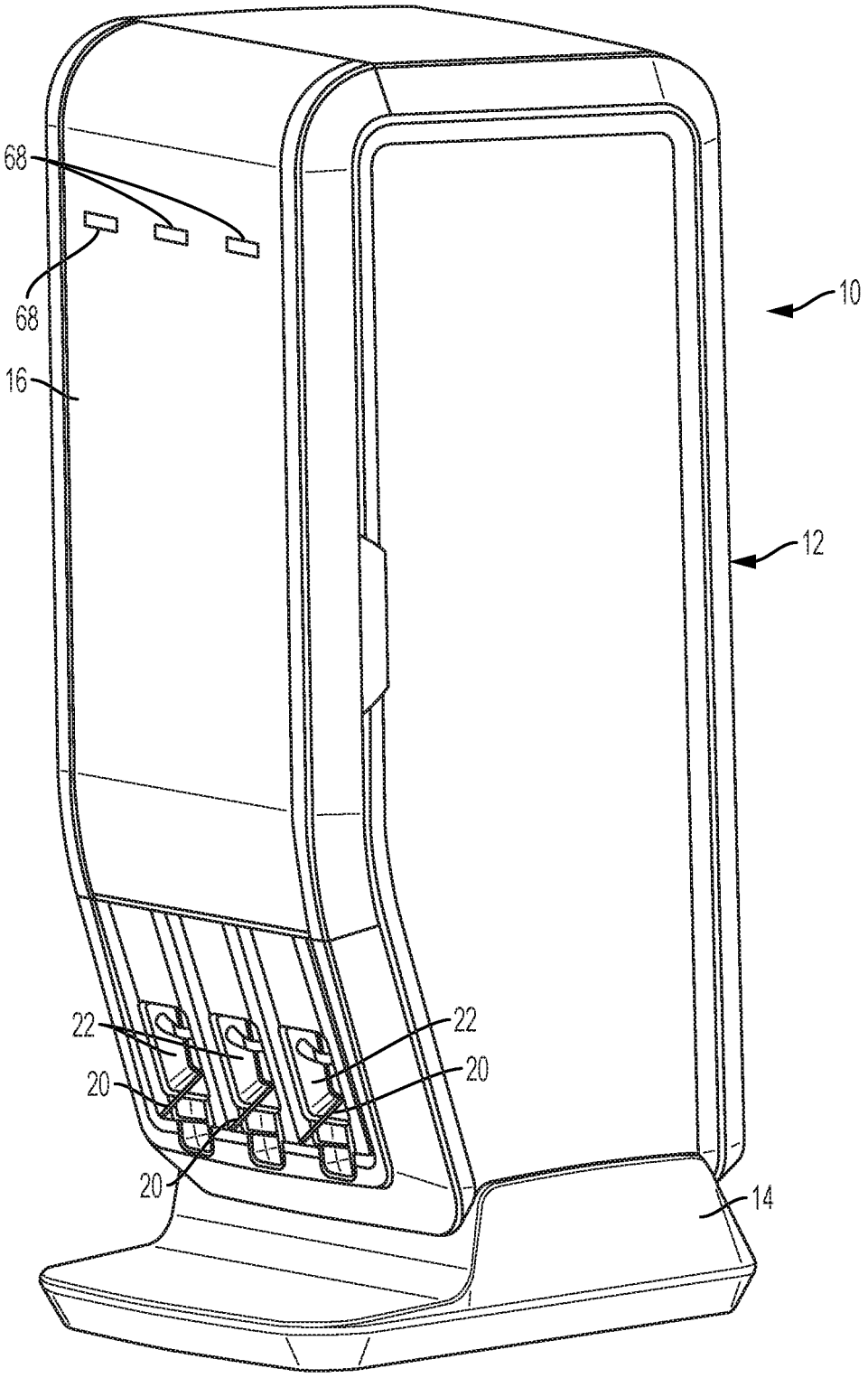
FIG. 1 depicts a perspective view of an illustrative utensil dispenser, according to one or more embodiments.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure. The figures are not necessarily to scale and certain features and certain views of the figures may be shown exaggerated in scale or in schematic for clarity and/or conciseness Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same may be equally effective at various angles or orientations.

Figure 2:
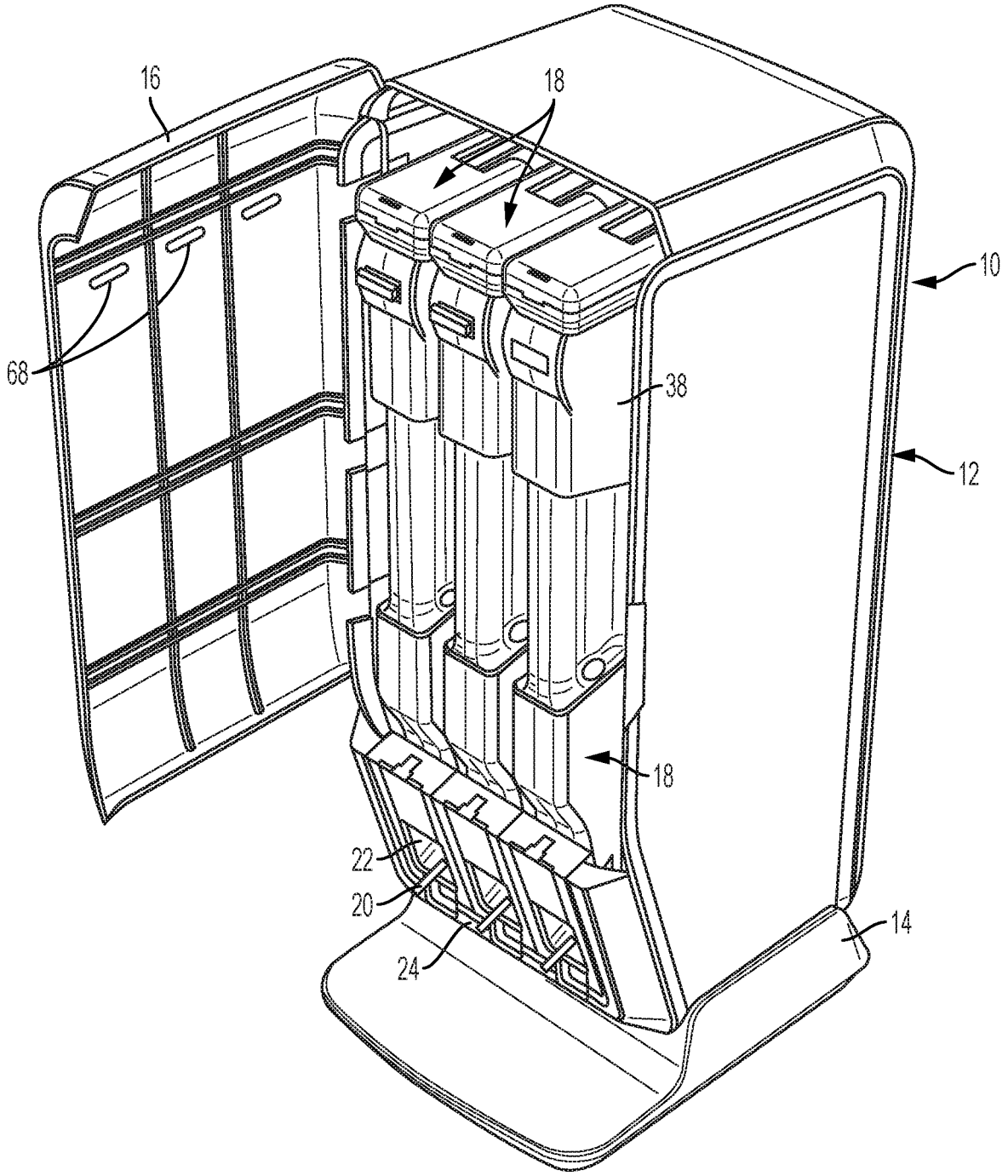
FIG. 2 depicts another perspective view of the illustrative utensil dispenser with an access door open to reveal one or more dispense chassis located therein, according to one or more embodiments.

FIGS. 1 and 2 depict a perspective view of an illustrative utensil dispenser 10, according to one or more embodiments. The utensil dispenser 10 can include a body 12 having a base 14 and an access door 16, which can be closed while the utensil dispenser 10 is operated, as depicted in FIG. 1, and the access door 16 can be opened to reveal the inside of the body 12, as depicted in FIG. 2. Referring to FIGS. 1 and 2, the utensil dispenser 10 can include one or more dispense chassis 18 for dispensing a plurality of utensils 20 through an access port 22. A user or customer can grasp a handle 24 of the utensil 20 and pull the utensil 20 free from the utensil dispenser 10 for use. In response to the removal or dispensing of the utensil 20 by the user, the utensil dispenser 10 can position another utensil 20 to be dispensed with the utensil handle 24 accessible via the access port 22. The utensil dispenser 10 can dispense plastic cutlery, e.g., polystyrene utensils. As one utensil 20 is removed, another utensil 20 can be moved into position such that handle 24 is outside the access port 22. Head portions of utensils 20 that can come into contact with food, e.g., fork tines, spoon bowls, knife blades, etc., can remain within the utensil dispenser 10. Accordingly, these portions of the utensils can be protected from the environment. The utensil dispenser 10 can be used to dispense various utensils such as, but not limited to, spoons, forks, knives, sporks, chopsticks, etc.

A utensil dispenser 10 can be hung on a wall using wall mounting bracket attachment holes (not shown). The utensil dispenser 10 can be attached to a base 14. The base 14 can provide support for the utensil dispenser 10 and allows the utensil dispenser 10 to be free standing. The base 14 can be removable such that the utensil dispenser 10 can be wall mounted using wall mounting bracket attachment holes. Multiple utensil dispensers 10 can be hung on a wall.

Utensils 20 stored in the utensil dispenser 10 can be stored in a dispense chassis 18. The utensil dispenser 10 can be opened allowing the replacement of dispense chassis 18 to refill the utensil dispenser 10. The utensil dispenser 10 can open using a hinge. A hinged access door 16 can allow access to the internal compartment of the utensil dispenser 10. The hinge location can be located on the top, bottom, or side of the utensil dispenser 10. Access door 16 can have fill level windows (not shown). Dispense chassis 18 can have corresponding fill level windows (not shown) that allow a visual indication of the stock of utensils 20 in each respective dispense chassis 18 to be seen. A dispense chassis 18 can be attached to or inserted within the utensil dispenser 10 and provides utensils 20 that can be dispensed. The dispense chassis 18 can be pre-packaged with utensils 20. In some implementations, the dispense chassis 18 is replaced with a new dispense chassis and is not reused. In other implementations, the dispense chassis 18 can be refilled and reused in the utensil dispenser 10. The utensil dispenser 10 can accept one, two, three or more dispense chassis. The utensil dispenser 10 of FIG. 2 is shown with three dispense chassis 18, e.g., one for each of a spoon, fork, and knife, but any combination of utensils may be used. The dispense chassis 18 can be in communication with any dispensing slot. Accordingly, a dispense chassis 18 of any type of utensil 20 can be placed into any available dispensing slot.

Alternatively, each dispense chassis 18 and dispensing slot can be unique to the utensil 20 being dispensed. A dispense chassis 18 can be designed individually to fit the corresponding utensil 20. The footprint and dimensions of the dispense chassis 18 can be distinct from one another in these implementations and the shape of the openings therein can be designed for a specific type of utensil.

Figure 3A:
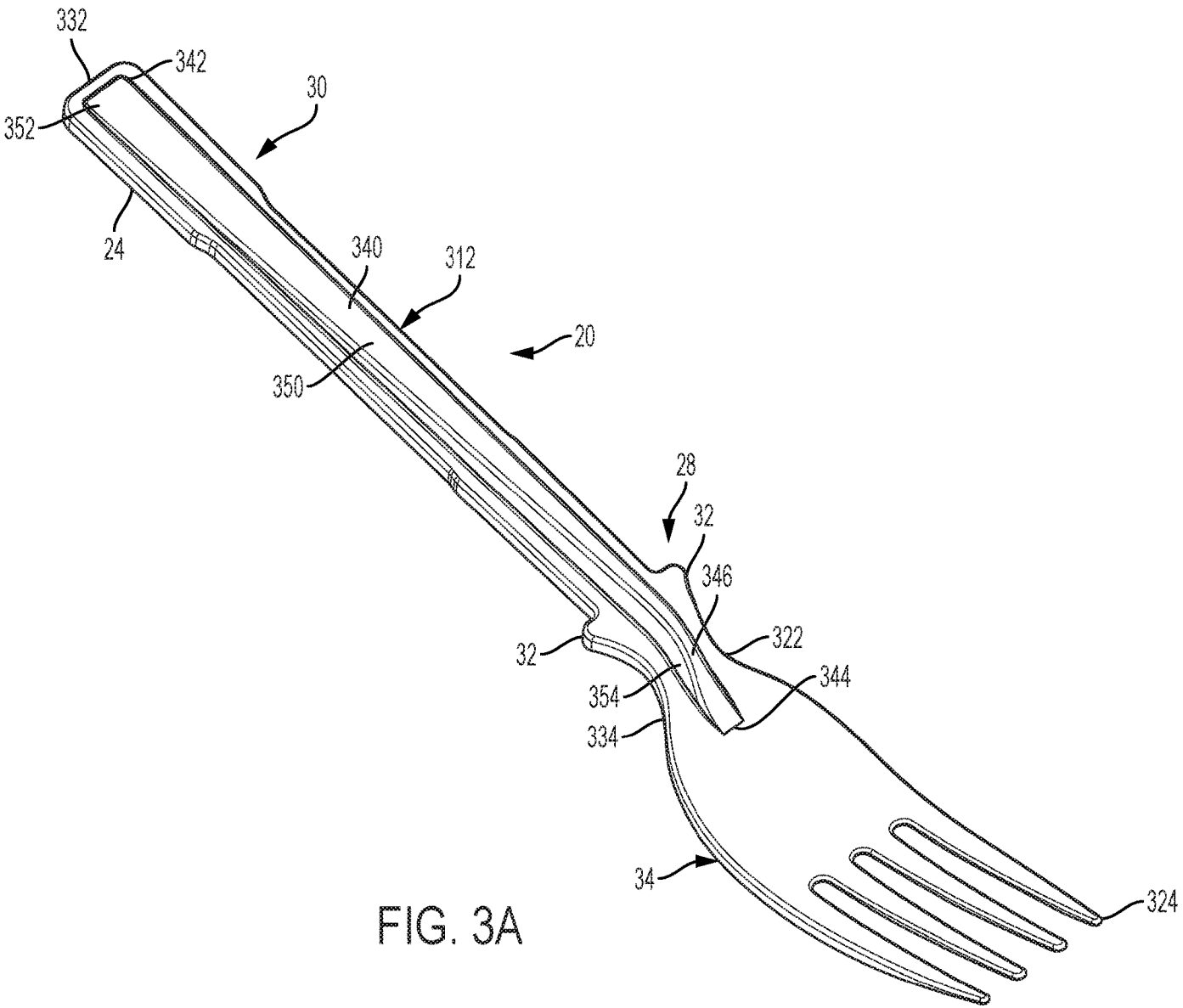
FIG. 3A depicts a perspective view of an illustrative utensil suitable for use with the illustrative utensil dispenser, according to one or more embodiments.
Figure 3B:
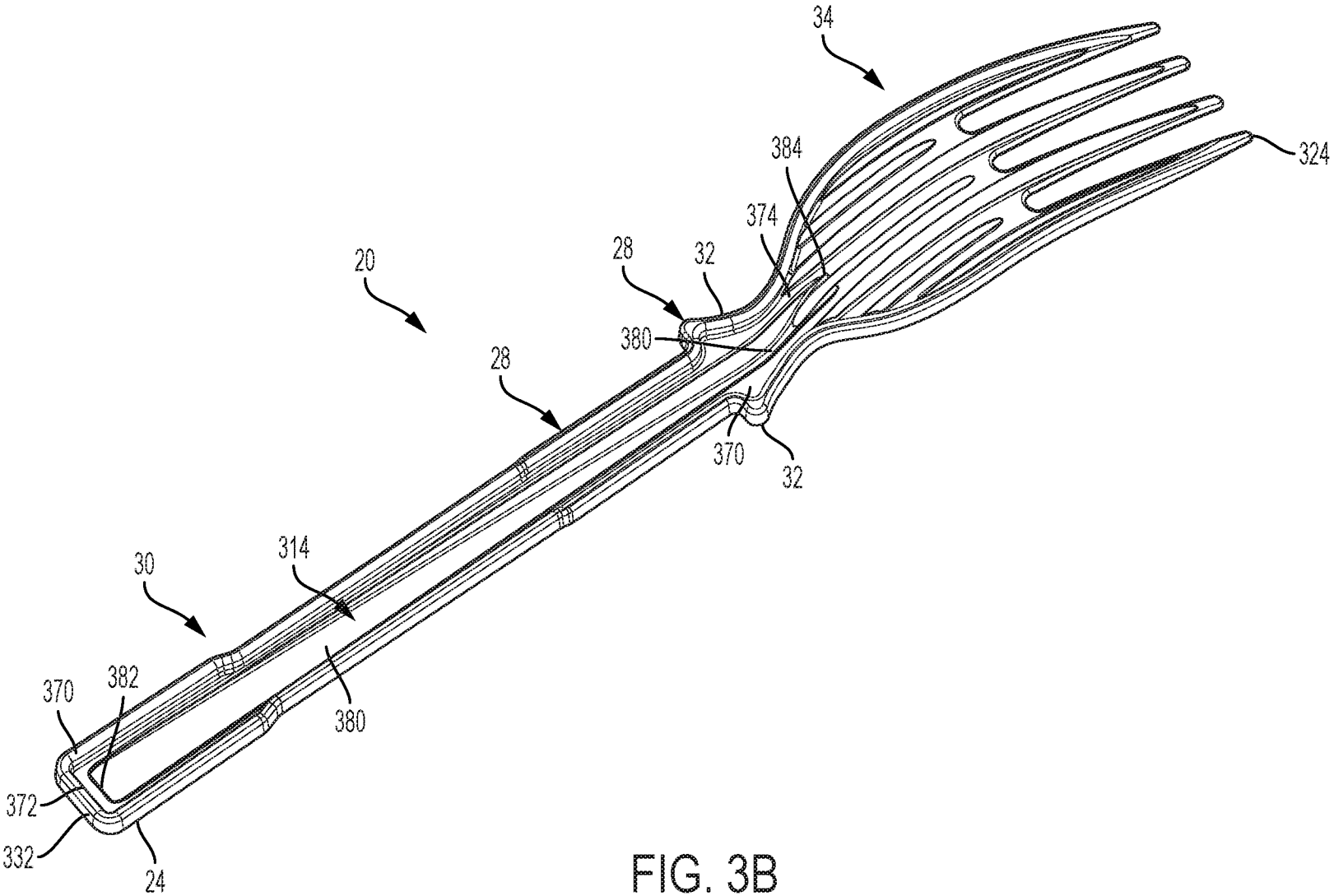
FIG. 3B depicts a bottom view of the utensil shown in FIG. 3A, according to one or more embodiments.
Figure 3C:
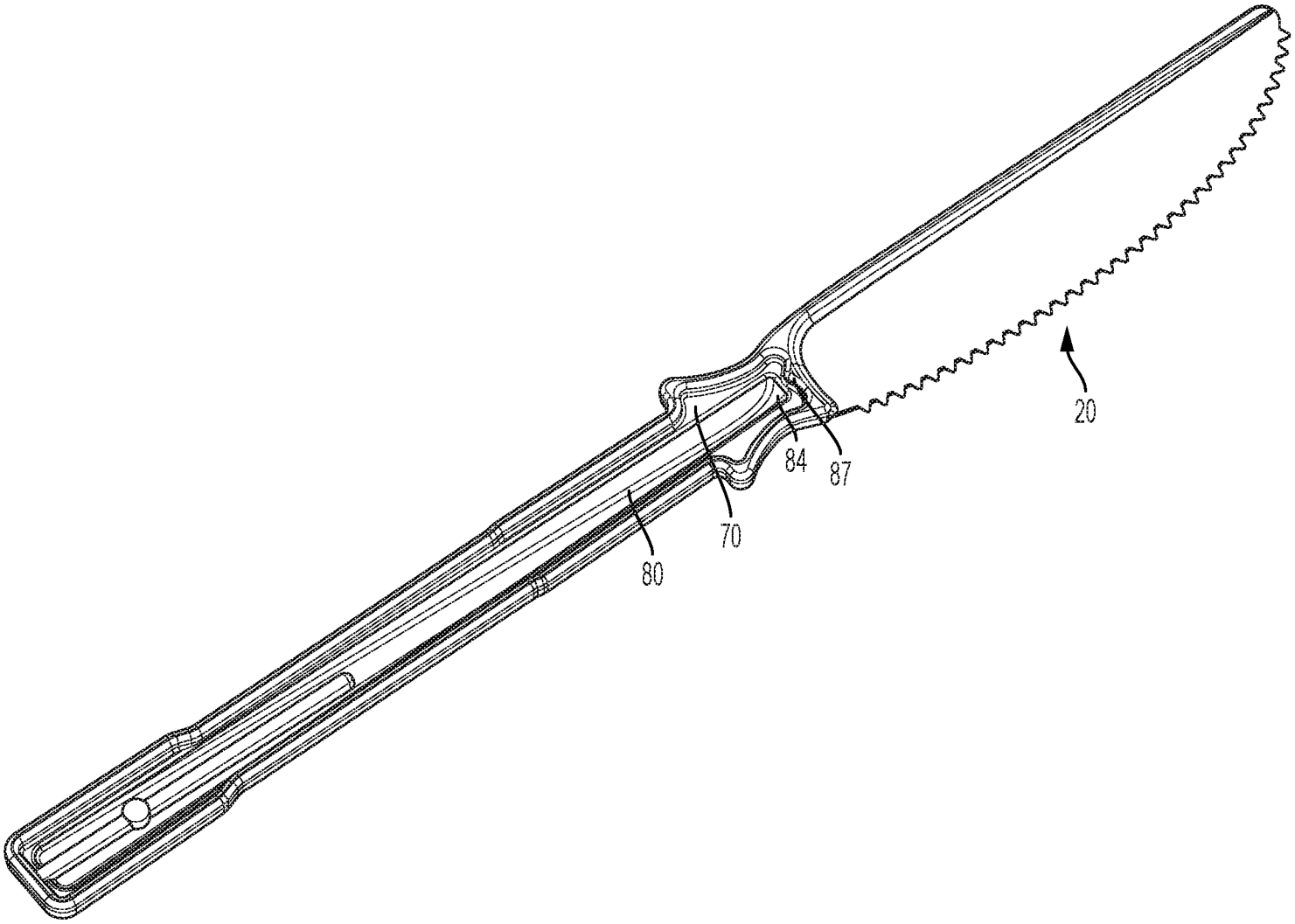
FIG. 3C depicts a bottom perspective view of an illustrative knife suitable for use with the illustrative utensil dispenser, according to one or more embodiments.

FIG. 3A depicts a perspective view of the utensil 20, and FIGS. 3B and 3C depict bottom views and bottom perspective views of the utensil 20, according to one or more embodiments. Each utensil 20 can have a functional portion or section 20 adjacent and adjoining a handle 30. The functional section 34 can be configured to perform a function that assists in the consumption of food, such as for example, cutting, piercing, and/or scooping. The functional section 34 can have a first end 322 that is adjacent to the handle 30, and a second end 324 that is distal from the handle 30. The handle 30 can be utilized by a user to hold and/or manipulate the utensil 20. The handle 30 can have a first end 332 and a second end 334. For sake of reference, the first end 332 of the handle 30 can be the end furthest from the functional section 34, and the second end 334 can be the end adjacent and adjoining (i.e. closest) the functional section 34. Each utensil 20 can be disposable and constructed from a formable material. The formable material can include, for example, plastic, combinations of plastics, or combinations of plastics and other materials suitable for use as disposable or reusable cutlery. In certain embodiments, the formable material can be or include polystyrene, polyethylene, polypropylene, as well as blends and mixtures thereof. The utensil 20 can include a first portion 28 that can be or can include wings or detents 32 on one or both sides of the utensil 20. The utensil 20 can also include a second portion 30 that can be or can include a tail support and/or the handle 24. The first portion 28 and the second portion 30 can be incorporated into other utensils such as, but not limited to, spoons, knives, forks, sporks, etc.

Each utensil 20 can include an axially oriented protrusion or raised spine 340 extending outwardly and away from a first or upper surface 312 of the utensil 20. The raised spine 340 can form a raised portion of the handle 30 and/or the functional section 34. The raised spine 340 can extend from the first end 332 of the handle 30 to the second end 334 of the handle 30. The raised spine 340 can also extend into the functional section 34. The raised spine 340 can be continuous from its first end 342 to its second end 344, or the raised spine 340 can be intermittent (i.e. non-continuous). In one embodiment, the first end 342 of the raised spine 340 can be proximate the handle 30, and the second end 344 of the raised spine 340 can be proximate the functional section 34.

The length of the raised spine 340 can extend over the entire length of the handle 30, or any portion thereof. For example, the length of the raised spine 340 can be about 10%, about 20%, about 30% or more of the length of the handle 30. The length of the raised spine 340 also can be about 70%, about 80%, about 90% or more of the length of the handle 30. The length of the raised spine 340 also can range from a low of about 15%, about 25%, or about 35% to a high of about 85%, about 95%, about 105%, or about 155% of the length of the handle 30. The length of the raised spine 340 as measured from its first end 342 to its second end 344 can be at least 1 cm, at least 2 cm, at least 3 cm, at least 4 cm, at least 5 cm, between 0.5 and 5 cm, between 0.5 and 4 cm, between 0.5 and 3 cm, between 0.5 and 2 cm, between 1 and 5 cm, between 1 and 4 cm, between 1 and 3 cm, between 1 and 2 cm, between 2 and 5 cm, between 2 and 4 cm, or between 2 and 3 cm.

The raised spine 340 can have a height that varies from its first end 342 to its second end 344. The height of the raised spine 340 can increase or slant from its first end 342 to its second end 344, i.e., in the direction toward the functional section 34. The height of the raised spine 340 can decrease or slant from its first end 342 to its second end 344, i.e., in the direction toward the functional section 34. The changes in the height of the raised spine 340 from the first end 342 to its second end 344 can be gradual or the changes can occur intermittently at different points along the raised spine 340. The highest point or portion of the raised spine 340 is its crown 346. The crown 346 can be proximate or adjacent to the second end 334 of the handle 30 or the first end 322 of the functional section 34 or be proximate or adjacent to the first end 34 of the handle 30 or any other suitable location along the utensil. The spine crown 346 can have a height measured from the first surface 312 to the top of the spine crown 346 that is greater than 0.1 cm, greater than 0.2 cm, greater than 0.3 cm, greater than 0.4 cm, greater than 0.5 cm, less than 0.5 cm, less than 0.4 cm, less than 0.3 cm, less than 0.2 cm, between 0.1 cm and 0.5 cm, between 0.1 cm and 0.4 cm, between 0.1 cm and 0.3 cm, between 0.1 cm and 0.2 cm, between 0.2 cm and 0.5 cm, between 0.2 cm and 0.4 cm, between 0.2 cm and 0.3 cm, or between 0.3 cm and 0.5 cm.

The raised spine 340 can have a width that varies between its first end 342 and its second end 344. The width of the raised spine 340 can decrease from its first end 342 towards its second end 344, i.e. in the direction from the handle 30 toward the functional section 34. The width of the raised spine 340 also can increase in the direction from the handle 30 toward the functional section 34. In certain embodiments, the widest portion of the raised spine 340 is at the spine crown 346. The raised spine 340 can have a maximum width that is greater than 0.1 cm, greater than 0.2 cm, greater than 0.3 cm, greater than 0.4 cm, greater than 0.5 cm, between 0.1 and 0.5 cm, less than 1.5 cm, less than 1.0 cm, less than 0.8 cm, less than 0.6 cm, between 0.1 and 1.0 cm, between 0.1 cm and 0.8 cm, between 0.1 cm and 0.6 cm, between 0.2 cm and 1.0 cm, between 0.2 cm and 0.8 cm, between 0.2 cm and 0.6 cm, or between 0.3 cm and 1.0 cm. The maximum width of the raised spine 340 can be proximate or adjacent the first end 342 of the raised spine 340. The width of the raised spine 340 at its first end 342 can be greater than about 50%, about 60%, about 70%, about 80%, about 90%, or about 95% of the width of the handle 30. The width of the raised spine 340 at its second end 344 can be greater than about 55%, about 65%, about 75%, about 85%, about 95%, or about 98% of the width of the handle 30.

The raised spine 340 can have a minimum width that is less than 0.5 cm, less than 0.4 cm, less than 0.3 cm, less than 0.2 cm, less than 0.1 cm, between 0.1 and 0.5 cm, between 0.1 and 0.4 cm, between 0.1 and 0.3 cm, between 0.1 and 0.2 cm, between 0.2 and 0.5 cm, between 0.2 and 0.4 cm, between 0.2 and 0.3 cm, or between 0.3 and 0.5 cm. The minimum width of the raised spine 340 on the handle 30 can be at the spine crown 346. The width of the raised spine 340 at the spine crown 346 can be less than 50% of the width of the handle 30 at the raised spine crown 346, less than 40% of the width of the handle 30 at the raised spine crown 346, less than 30% of the width of the handle 30 at the raised spine crown 346, less than 20% of the width of the handle 30 at raised spine crown 346, less than 10% of the width of the handle 30 at raised spine crown 346.

The raised spine 340 can have a varying height along a first section 350 that can increase in the direction of the functional section 34. The first section 350 can have a first section end 352 that is relatively closer to the raised spine first end 342 and a second section end 354 that is relatively closer to the raised spine second end 344. The first section end 352 can be adjacent to the raised spine first end 342 or any suitable position along the length of the raised spine 340 where the raised spine begins to increase in height. The second section end 354 can be adjacent to the spine crown 346 or anywhere the raised spine 340 begins to decrease in height. The length of the first section 350 as measured from the first section end 352 to the second section end 354 can be at least 1 cm, at least 2 cm, at least 3 cm, at least 4 cm, at least 5 cm, at least 6 cm, at least 7 cm, at least 8 cm, at least 9 cm, at least 10 cm, less than 15 cm, less than 14 cm, less than 13 cm, less than 12 cm, less than 10 cm, less than 8 cm, between 0.5 and 15 cm, between 0.5 and 10 cm, between 0.5 and 8 cm, between 0.5 and 6 cm, between 1 and 55 cm, between 1 and 10 cm, between 1 and 8 cm, between 1 and 6 cm, between 2 and 15 cm, between 2 and 10 cm, or between 2 and 8 cm. The length of the first section can be greater than 50% of the length of the raised spine 340, greater than 70% of the length of the raised spine 340, greater than 80% of the length of the raised spine 340, greater than 90% of the length of the raised spine 340, greater than 95% of the length of the raised spine 340.

Utensil 20 can include at least one shaped extension 32 that is disposed on one or both sides of the utensil 20. The shaped extension 32 can be a wing, detent, or other shape protruding from the side of the utensil 20. The shaped extension 32 can extend laterally from a side of the functional section 34 or the side of the handle 30. The shaped extension 32 can be disposed on any suitable position along the length of the utensil 20. The shaped extension 32 can be disposed proximate the crown 346 of the raised spine 340. In certain embodiments, the shaped extension 32 can be two laterally opposed shaped extensions. A first shaped extension 32 can laterally extending from a first lateral side of the utensil 20 (e.g. from the handle 30 or the functional section 34), and a second shaped extension 32 laterally extending from an opposite of the utensil 20 (e.g. from the handle 30 or functional section 34). The first and second shaped extensions 32 can be co-planar. Each shaped extension 32 can have any shape or cross-section, including for example, wing-shaped, triangular, rectangular, square, hexagonal, pentagonal, or any other shape capable of forming a surface. If two or more shaped extensions 32 are used, the shape or cross-section of each shaped extension 32 can be the same or different. In certain embodiments, there could be multiple shaped extensions (not shown) on one side of the utensil 20 or on both sides of the utensil 20.

The handle 30 can be chamfered, tapered, or profiled anywhere along its length. For example, the first end 332 of the handle 30 can be chamfered, tapered, or profiled. The chamfer at the first end 332 can make it easier for the dispensing unit to pick between utensils 20 when stacked. In some embodiments, a portion of each handle 30 can be cutout to provide a thinner section or profile. Similar to a chamfer, this cutout in the handle 30 can make it easier for a dispensing unit (not shown) to pick between utensils 20.

Still referring to FIGS. 3*a* and 3*b*, as the utensils 20 can be stacked in a dispense chassis, one or more nesting features can be used to stabilize a stack 120 of utensils 20. The handle 30 can have one or more cutouts disposed along a length thereof for receiving a band (shown in FIG. 8) to help the utensils 20 remain in a stacked orientation. For example, a cutout section can be formed in the handle 30 between a first shoulder or cutout 336 and the shaped extension 32. In another example, a cutout section can be formed in the handle 30 between the first cutout 336 and a second shoulder or cutout 38. The length of the cutout as measured from the first cutout 336 to the second cutout 338 can be greater than 1 cm, greater than 2 cm, greater than 3 cm, greater than 4 cm, less than 10 cm, less than 8 cm, less than 6 cm, between 1 and 10 cm, between 1 and 8 cm, between 1 and 6 cm, between 2 and 10 cm, between 2 and 8 cm, between 2 and 6 cm. The width of the band can be about the same length as the length of the cutout. Additionally, one or both sides of the handle 30 can taper from the first cutout 336 toward the first end 332 of the handle 30. The taper can make the band tighten as the band is moved from the first cutout 336 toward the first end 332 of the handle 30. One or both sides of the handle 30 can taper from the second cutout 338 toward the second end 334 of the handle 30. The taper can make the band tighten as the band is moved from the second cutout 338 toward the second end 334 of the handle 30. Any tapers on the handle 30 can be continuous or intermittent. The band can be removed prior to or after the utensils 20 are loaded in a dispenser. In one embodiment, the band can be absent of adhesive that contacts the utensils 20. In a separate embodiment, the band can contain adhesive that contacts the utensils 20.

FIG. 3*b* depicts a bottom view of an illustrative fork, according to one or more embodiments. As seen in these bottom perspective view, the utensil 20 can have a second or bottom surface 14 that is opposite the upper or top surface 12. One or more channels or recessed groves 70, 80 (two are shown) can be formed in the second surface 314. Each recessed channel 70, 80 can extend along a portion, or all, of the second surface 314. As depicted, a first recessed channel 370 can be formed in the second surface 314 and a second recessed channel 380 can be formed within the first recessed channel 370. The maximum depth of the first recessed channel 370 or the second recessed channel 380 can be substantially equal to a maximum height of the raised spine 340.

First recessed channel 370 can have a first recessed channel first end 372 that can be adjacent to the first end 332 of the handle 30. The first recessed channel first end 372 can be less than 0.5 cm, less than 0.4 cm, less than 0.3 cm, less than 0.2 cm, or less than 0.1 cm from the first end 332 of the handle 30. First recessed channel 370 can have a first recessed channel second end 374 that can be on either the handle 30 or on the functional section 34. The first recessed channel second end 374 can be adjacent to either the first functional section end 22 or second end 334 of the handle 30. The first recessed channel second end 374 can be less than 0.5 cm, less than 0.4 cm, less than 0.3 cm, less than 0.2 cm, or less than 0.1 cm from the first functional section end 22. The first recessed channel second end 374 can be less than 0.5 cm, less than 0.4 cm, less than 0.3 cm, less than 0.2 cm, or less than 0.1 cm from the second end 334 of the handle 30.

The length of the first recessed channel 370 as measured from the first recessed channel first end 372 to the first recessed channel second end 374 can be at least 1 cm, at least 2 cm, at least 3 cm, at least 4 cm, at least 5 cm, at least 6 cm, at least 7 cm, at least 8 cm, at least 9 cm, at least 10 cm, less than 15 cm, less than 14 cm, less than 13 cm, less than 12 cm, less than 10 cm, less than 8 cm, between 0.5 and 15 cm, between 0.5 and 10 cm, between 0.5 and 8 cm, between 0.5 and 6 cm, between 1 and 15 cm, between 1 and 10 cm, between 1 and 8 cm, between 1 and 6 cm, between 2 and 15 cm, between 2 and 10 cm, or between 2 and 8 mm. The length of the first recessed channel 370 can be substantially the same length as the raised spine 340. The length of the first recessed channel 370 can be at least 1 cm, at least 2 cm, at least 3 cm, at least 4 cm, at least 5 cm, between 0.5 and 5 cm, between 0.5 and 4 cm, between 0.5 and 3 cm, between 0.5 and 2 cm, between 1 and 5 cm, between 1 and 4 cm, between 1 and 3 cm, between 1 and 2 cm, between 2 and 5 cm, between 2 and 4 cm, or between 2 and 3 cm longer than the length of the raised spine 340.

The first recessed channel 370 can have a constant depth or varying depth that can increase in depth in the direction of the functional section 34 until reaching a maximum depth. The maximum depth of the first recessed channel 370 can be adjacent to the second end 334 of the handle 30 or the first end 322 of the functional section 34. The first recessed channel 370 can have a depth measured from the second surface 314 to the bottom of the first recessed channel 370 that is greater than 0.1 cm, greater than 0.2 cm, greater than 0.3 cm, greater than 0.4 cm, greater than 0.5 cm, between 0.1 and 0.5 cm, between 0.1 and 0.4 cm, between 0.1 and 0.3 cm, between 0.1 and 0.2 cm, between 0.2 and 0.5 cm, between 0.2 and 0.4 cm, between 0.2 and 0.3 cm, or between 0.3 and 0.5 cm.

The first recessed channel 370 can have a fairly constant width, a varying width that can decrease in width in the direction of the functional section 34 until reaching a minimum width, or can increase in width in the direction of the functional section 34 until reaching a maximum width or other suitable configuration. The first recessed channel 370 can have a maximum width that is greater than 0.1 cm, greater than 0.2 cm, greater than 0.3 cm, greater than 0.4 cm, greater than 0.5 cm, between 0.1 and 0.5 cm, between 0.1 and 0.4 cm, between 0.1 and 0.3 cm, between 0.1 and 0.2 cm, between 0.2 and 0.5 cm, between 0.2 and 0.4 cm, between 0.2 and 0.3 cm, or between 0.3 and 0.5 cm. The maximum width of the first recessed channel 370 can be at the first recessed channel first end 372. The width of the first recessed channel 370 at first recessed channel first end 372 can be greater than 50% of the width of the handle 30 at first recessed channel first end 372, greater than 70% of the width of the handle 30 first recessed channel first end 372, greater than 80% of the width of the handle 30 at the first recessed channel first end 372, greater than 90% of the width of the handle 30 at the first recessed channel first end 372, greater than 95% of the width of the handle 30 at the first recessed channel first end 372.

The first recessed channel 370 can have a minimum width that is less than 0.5 cm, less than 0.4 cm, less than 0.3 cm, less than 0.2 cm, less than 0.1 cm, between 0.1 and 0.5 cm, between 0.1 and 0.4 cm, between 0.1 and 0.3 cm, between 0.1 and 0.2 cm, between 0.2 and 0.5 cm, between 0.2 and 0.4 cm, between 0.2 and 0.3 cm, or between 0.3 and 0.5 cm. The minimum width of the first recessed channel 370 can be adjacent to the shaped extension(s) 60. The minimum width of the first recessed channel 370 can be less than 50% of the width of the handle 30 at the minimum width of the first recessed channel 370, less than 40% of the width of the handle 30 at the minimum width of the first recessed channel 370, less than 30% of the width of the handle 30 at the minimum width of the first recessed channel 370, less than 20% of the width of the handle 30 at the minimum width of the first recessed channel 370, less than 10% of the width of the handle 30 at the minimum width of the first recessed channel 370. The first recessed channel 370 can receive a raised spine 340 of an adjacent utensil in a stack of utensils. The raised spine 340 of the second utensil can nest within the first recessed channel 370. This nesting of raised spine 340 within the first recessed channel 370 of another adjacent utensil and can increase the stability of a stack of utensils without increasing the height of the stack of utensils.

Second recessed channel 380 can have a second recessed channel first end 382. The second recessed channel first end 382 can be adjacent to the first end 332 of the handle 30. The second recessed channel first end 382 can be less than 0.5 cm, less than 0.4 cm, less than 0.3 cm, less than 0.2 cm, or less than 0.1 cm from the first end 332 of the handle 30. Second recessed channel 380 can have a second recessed channel second end 384 that can be on either the handle 30 or on the functional section 34. The second recessed channel second end 384 can be adjacent to either the first end 22 of the functional section 34 or second end 334 of the handle 30. The second recessed channel second end 384 can be less than 0.5 cm, less than 0.4 cm, less than 0.3 cm, less than 0.2 cm, or less than 0.1 cm from the first functional section end 22. The second recessed channel second end 384 can be less than 0.5 cm, less than 0.4 cm, less than 0.3 cm, less than 0.2 cm, or less than 0.1 cm from the second end 334 of the handle 30.

The length of the second recessed channel 380 as measured from the second recessed channel first end 382 to the second recessed channel second end 384 can be at least 1 cm, at least 2 cm, at least 3 cm, at least 4 cm, at least 5 cm, between 0.5 and 5 cm, between 0.5 and 4 cm, between 0.5 and 3 cm, between 0.5 and 2 cm, between 1 and 5 cm, between 1 and 4 cm, between 1 and 3 cm, between 1 and 2 cm, between 2 and 5 cm, between 2 and 4 cm, or between 2 and 3 cm. The length of the second recessed channel 380 can be substantially the same length as the raised spine 340.

The second recessed channel 380 can have a varying depth that can increase in depth in the direction of the functional section 34 until reaching a maximum depth. The maximum depth of the second recessed channel 380 can be adjacent to the second end 334 of the handle 30 or the first functional section end 32 or opposite the spine crown 346. The second recessed channel 380 can have a depth measured from the second surface 314 to the bottom of the second recessed channel 380 that is greater than 0.1 cm, greater than 0.2 cm, greater than 0.3 cm, greater than 0.4 cm, greater than 0.5 cm, between 0.1 and 0.5 cm, between 0.1 and 0.4 cm, between 0.1 and 0.3 cm, between 0.1 and 0.2 cm, between 0.2 and 0.5 cm, between 0.2 and 0.4 cm, between 0.2 and 0.3 cm, or between 0.3 and 0.5 cm. The second recessed channel 380 can have a relative depth measured from the bottom of the first recessed channel 370 to the bottom of the second recessed channel 380 that is greater than 0.1 cm, greater than 0.2 cm, greater than 0.3 cm, greater than 0.4 cm, greater than 0.5 cm, less than 1.5 cm, less than 1.0 cm, less than 0.8 cm, less than 0.6 cm, between 0.1 and 1.5 cm, between 0.1 and 1.0 cm, between 0.1 and 0.8 cm, between 0.1 and 0.6 cm, between 0.2 and 1.5 cm, between 0.2 and 1.0 cm, between 0.2 and 0.8 cm, or between 0.3 and 0.6 cm.

The second recessed channel 380 can have a varying width that can decrease in width in the direction of the functional section 34 until reaching a minimum width. The second recessed channel 380 can have a maximum width that is greater than 0.1 cm, greater than 0.2 cm, greater than 0.3 cm, greater than 0.4 cm, greater than 0.5 cm, between 0.1 and 0.5 cm, between 0.1 and 0.4 cm, between 0.1 and 0.3 cm, between 0.1 and 0.2 cm, between 0.2 and 0.5 cm, between 0.2 and 0.4 cm, between 0.2 and 0.3 cm, or between 0.3 and 0.5 cm. The maximum width of the second recessed channel 380 can be at the second recessed channel first end 382 or any suitable location. The width of the second recessed channel 380 at second recessed channel first end 382 can be greater than 50% of the width of the handle 30 at the second recessed channel first end 382, greater than 70% of the width of the handle 30 at the second recessed channel first end 382, greater than 80% of the width of the handle 30 at the second recessed channel first end 382, greater than 90% of the width of the handle 30 at the second recessed channel first end 382, greater than 95% of the width of the handle 30 at the second recessed channel first end 382.

The second recessed channel 380 can have a minimum width that is less than 0.5 cm, less than 0.4 cm, less than 0.3 cm, less than 0.2 cm, less than 0.1 cm, between 0.1 and 0.5 cm, between 0.1 and 0.4 cm, between 0.1 and 0.3 cm, between 0.1 and 0.2 cm, between 0.2 and 0.5 cm, between 0.2 and 0.4 cm, between 0.2 and 0.3 cm, or between 0.3 and 0.5 cm. The minimum width of the second recessed channel 380 can be adjacent to the shaped extension(s) 60. The minimum width of the second recessed channel 380 can be less than 50% of the width of the handle 30 at the minimum width of the second recessed channel 380, less than 40% of the width of the handle 30 at the minimum width of the second recessed channel 380, less than 30% of the width of the handle 30 at the minimum width of the second recessed channel 380, less than 20% of the width of the handle 30 at the minimum width of the second recessed channel 380, less than 10% of the width of the handle 30 at the minimum width of the second recessed channel 380. The second recessed channel 380 can receive a raised spine 340 of an adjacent utensil in a stack of utensils. The raised spine 340 of the second utensil can nest within the second recessed channel 380. This nesting of raised spine 340 within the second recessed channel 70 of another adjacent utensil and can increase the stability of a stack of utensils without increasing the height of the stack of utensils.

The first or second recessed channel 370, 380 can have at least one counterweight (not shown) protruding from the surface of the second recessed channel 380. The counterweight can be adjacent to the handle end 332. The length of the counterweight as measured from the counterweight first end 92 to the counterweight second end 94 can be at least 0.5 cm, at least 1 cm, at least 2 cm, at least 3 cm, at least 4 cm, at least 5 cm, between 0.5 and 5 cm, between 0.5 and 4 cm, between 0.5 and 3 cm, between 0.5 and 2 cm, between 1 and 5 cm, between 1 and 4 cm, between 1 and 3 cm, between 1 and 2 cm. The shape of the counterweight can be a cube, cuboid, cylinder, triangular prism, sphere, cone, or any other shape that can serve the function of a counterweight. The counterweight can be disposed on the first recessed channel 370, the second recessed channel 380, or both the first recessed channel 370 and the second recessed channel 380. The counterweight can help provide balance and stability to the utensil 20 during use by acting as a counterweight to objects on the functional section 34 or as a counterweight when the utensil 20 is in a dispenser. This counterweight can make it easier to separate the utensils 20 using a utensil dispenser (not shown).

The utensils 20 can be stacked together to form a stack of utensils. The stack of utensils can have a reduced gap between the utensils 20. The gap at the first end of the handle 32 as measured by the distance of first surface 312 of the first utensil to the second surface 314 of the adjacent utensil in the stack of utensils can be less than 1 mm, less than 0.5 mm, less than 0.4 mm, less than 0.3 mm, less than 0.2 mm, or less than 0.1 mm. The gap at the second end 324 of the functional section as measured by the distance of first surface 312 of the first utensil to the second surface 314 of the adjacent utensils in the stack of utensils can be less than 1 cm, less than 0.5 cm, less than 0.4 cm, less than 0.3 cm, less than 0.2 cm, less than 0.1 cm, less than 1 mm, less than 0.5 mm, less than 0.4 mm, less than 0.3 mm, less than 0.2 mm, less than 0.1 mm. The gap at the first end 332 of the handle 30 between every utensil 20 in a stack of utensils can be substantially the same. The gap at the second end 324 of the functional section 20 between every utensil 20 in a stack of utensils can be substantially the same. Reducing the gap between the utensils 20 in a stack of utensils can reduce the height of the stack of utensils. The stack of utensils can be loaded into a dispenser with the first surface 312 facing down or with the second surface 314 facing down. The height of the stack of utensils in centimeters as measured by the distance from first surface 312 of the top utensil in a stack of utensils at the first end 332 of the handle 30 of to the second surface 314 of the bottom utensil in the stack of utensils at the first end 332 of the handle 30 of can be less than 100.1%, less than 100.5%, less than 101%, less than 102%, less than 103%, less than 104%, less than 105%, between 100% and 105%, between 100% and 104%, between 100% and 103%, between 100% and 102%, between 100% and 101%, between 100% and 100.5%, between 100.5% and 105%, between 100.5% and 104%, between 100.5% and 103%, between 100.5% and 102%, or between 100.5% and 101% of the height of the utensil 20 in centimeters as measured by the distance from the first surface 312 to the second surface 314 at the first end 332 of the handle 30 multiplied by the number of utensils 20 in the stack of utensils.

When the utensils 20 are stacked in a stack of utensils, an individual utensil 20 in the stack of utensils can generally only slide out of the stack of utensils in one direction. When the utensils 20 are stacked in a stack of utensils, an individual utensil 20 in the stack of utensils can generally only slide out in the direction from the handle 30 toward the functional section 34, from the functional section 34 toward the handle 30, or from both the direction from the handle 30 toward the functional section 34 and from the direction from the functional section 34 toward the handle 30. When the stack of utensils are loaded into a dispenser with the first surface 312 facing down, the utensils 20 can generally only slide in the direction from the handle 30 toward the functional section 34. The spine crown 346 can act as a wedge to prevent or otherwise restrict a utensil 20 that is directly below a utensil 20 in the stack of utensils from sliding out toward the first end 332 of the handle 30. The stop 348 can be disposed on the raised spine 46 proximate to the spine crown 346. The stop 348 can prevent or otherwise restrict a utensil 20 that is directly below a utensil 20 in the stack of utensils from sliding out from the handle 30 toward the functional section 34 or from the functional section 34 toward the handle 30. When the stack of utensils are loaded into a dispenser with the first surface 312 facing down, the stop 348 can prevent or otherwise restrict a utensil 20 that is directly below a utensil 20 in the stack of utensils from sliding out from the functional section 34 toward the handle 30.

Figure 4:
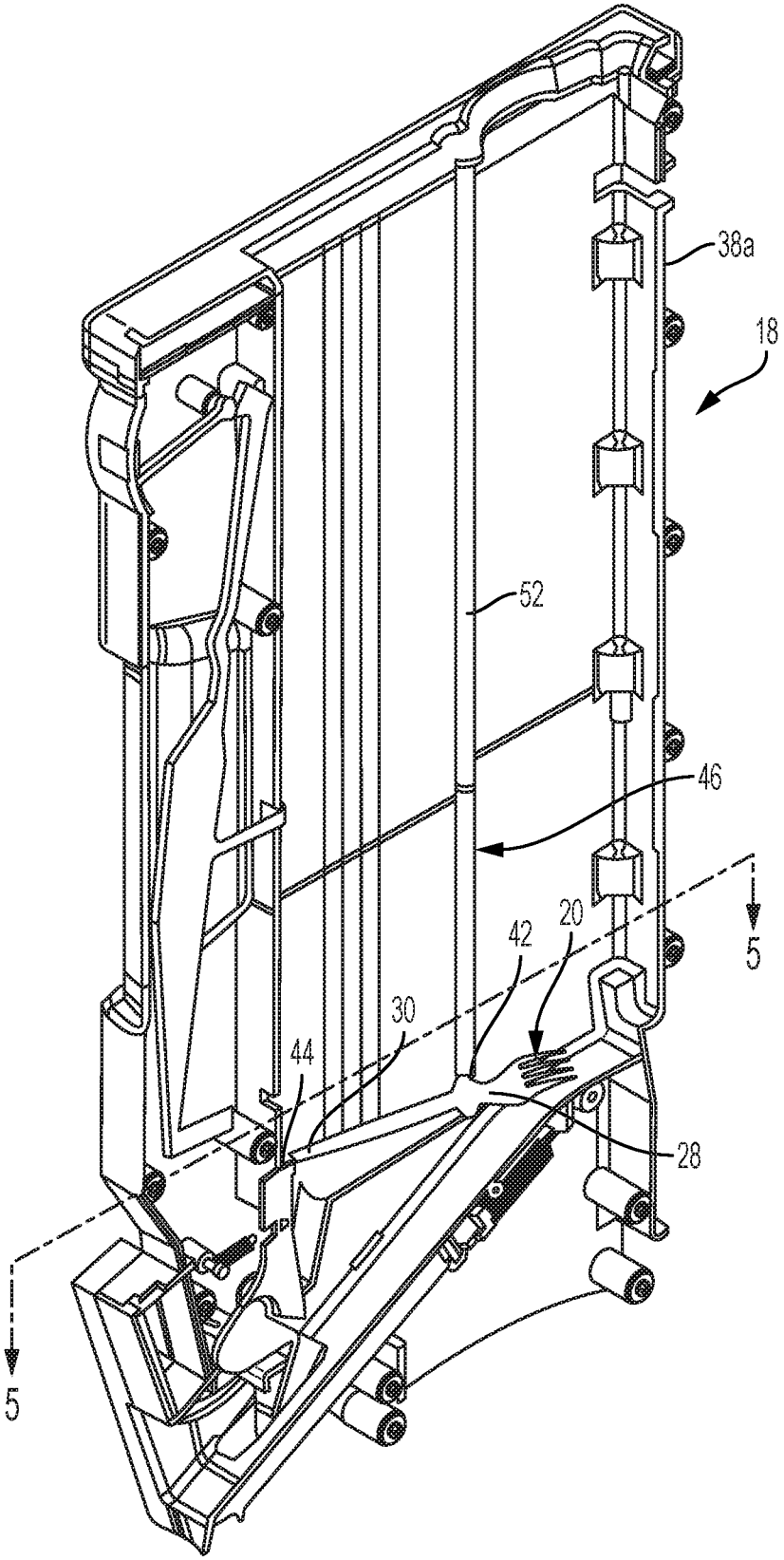
FIG. 4 depicts a partial perspective view of an illustrative dispense chassis, according to one or more embodiments.

FIG. 4 depicts a partial perspective view of the dispense chassis 18 shown in FIG. 2 showing a portion of a housing 38*a*. Another portion of the housing 38*b* of the dispense chassis 18 has been removed in FIG. 4 to reveal interior details of the dispense chassis 18. The housing 38 can contain one or more of the utensils 20, and can include a front pedestal 42 that can support and contact the first portion 28 of the utensil 20 and a rear pedestal 44 that can support and contact the second portion 30 of the utensil 20. The housing 38 can also include at least one generally vertical guide rail 46 which can be configured for maintaining the utensils 20 in a stacked orientation. The first portion 28 can be positioned within the guide rail 46 to assist in maintaining the utensils 20 in the stacked orientation. To help increase stability of the stack 56 and maximize the usage of space within the dispense chassis 18, each utensil 20 can include one or more nesting features, such as a chamfered end, a concave cavity, ribbing, a cutout to provide a thinner endpoint in the handle of each utensil, just to name a few. A utensil 20 can be stacked vertically on a second utensil 20. The utensils 20 can be the same height, width, and length. A cut out (not shown) in a handle 24 of the utensil 20 can allow for a thinner endpoint that can be used by the dispensing portion of the utensil dispenser 10 to separate individual utensils 20. A nesting feature can be used to help maintain the utensils 20 in a stacked configuration within the dispense chassis 18.

The dispensing of utensils 20 can be enhanced based upon one or more features of the utensils themselves. The handle 24 can be chamfered. The chamfer can make it easier for the dispensing unit to pick between utensils. Similar to the chamfer, cutouts from the handle 24 can also make it easier for the dispensing unit to pick between utensils 20. As the utensils 20 can be stacked in dispense chassis, nesting features can be used to stabilize the utensil stack 56. A concave cavity (not shown) can be used such that one utensil 20 can nest into another utensil 20.

Figure 5:
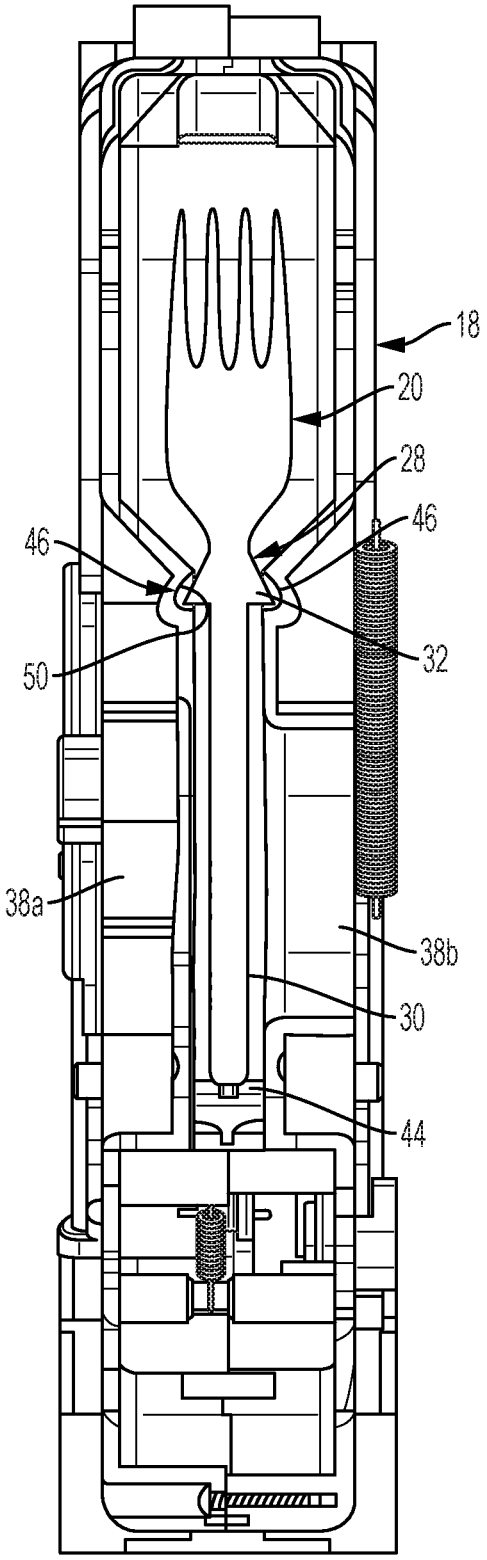
FIG. 5 depicts a cross section plan view of the illustrative dispense chassis showing one or more support rails disposed therein, according to one or more embodiments.

FIG. 5 depicts a cross section plan view of the dispense chassis 18 showing one or more support or guide rails 46 disposed therein, according to one or more embodiments. FIG. 5 shows two portions of the housing 38, a first portion 38*a* and a second portion 38*b*. The guide rail 46 can extend the entire length of the chassis 18 or any portion thereof. The guide rail 46 has a cross section that is sized and shaped to encapsulate or otherwise surround the stack 56 of utensils 20. The guide rail 46 can include one more contours or recessed portions 50 formed therein. The contour 50 can be shaped and/or have a cross section that is complementary to the wings or detents 32 on the sides of the utensil 20. In use, the wings or detents 32 of each utensil 20 fits within the contour 50, and the remaining portions of the utensil 20 fit within the remaining portion of the guide rail 46.

As mentioned previously, the housing 38 can include a first side or portion 38*a* and second side or portion 38*b*. In such embodiment, a first portion of the utensil rail 46 can be formed in the first portion 38*a* of the housing 38, and a second portion of the guide rail 46 can be formed in the second portion 38*b* of the housing 38, such that each portion of the guide rail 46 is located on opposite sides of the housing 38 and each portion of the utensil rail 46 has a contour 50 formed therein that complements the shape of the detent 32 of each utensil 20.

Figure 6:
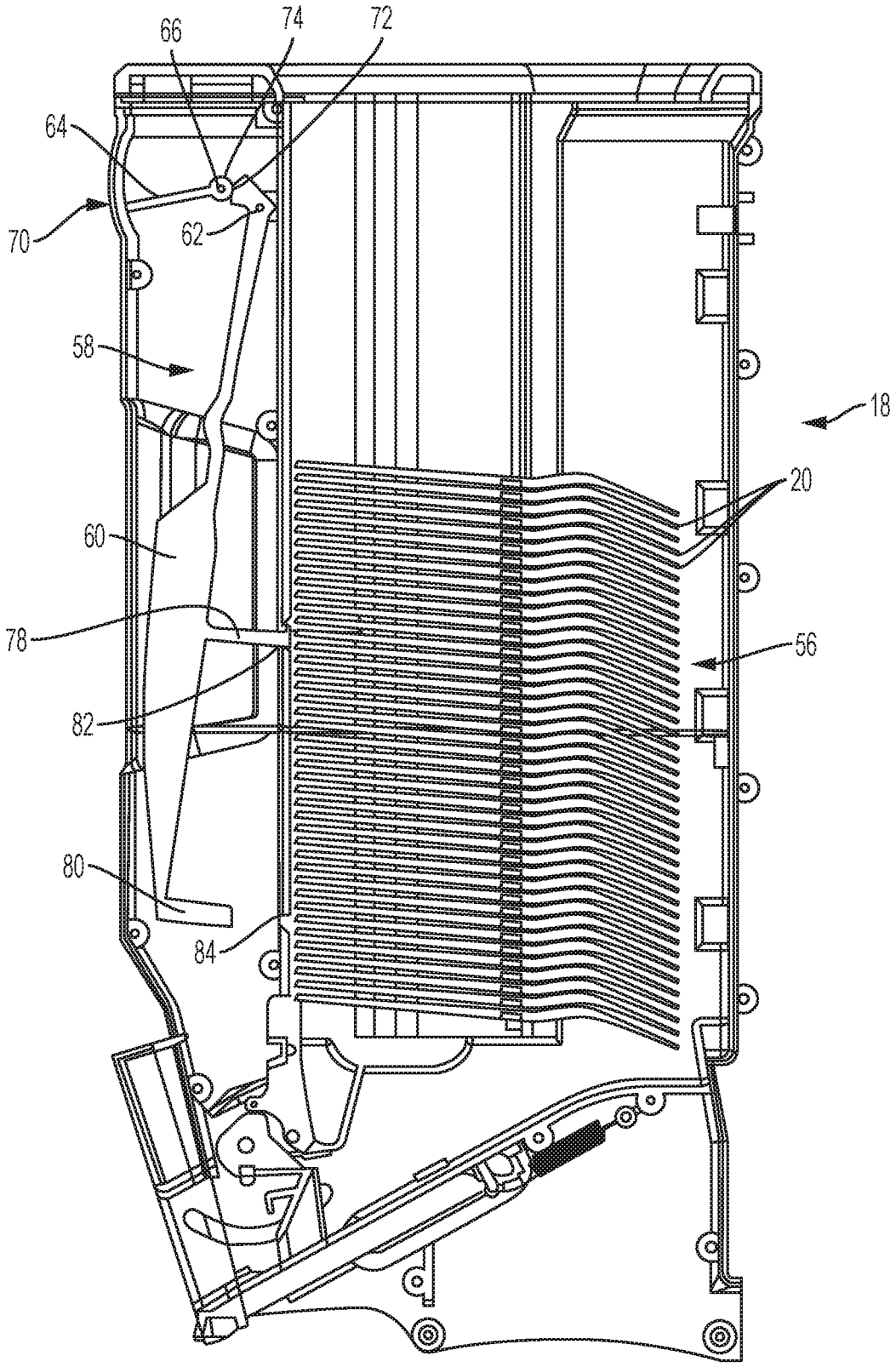
FIG. 6 depicts a cut away elevation view of the illustrative dispense chassis, according to one or more embodiments.

Referring again to FIG. 4, the guide rail 46 can be vertically aligned above the front pedestal 42 and can guide the utensils 20 such that the first portion 28 of the bottom utensil 21 is placed on the front pedestal 42. As shown in FIG. 6, the guide rail 46 with contour section 50 can retain and help the stack 56 of utensils 20 remain in a stacked orientation. If there is more than one utensil rail (not shown) on the same side of the housing, there can be additional wings or detents (not shown) on the sides of utensil 20 complementary to the additional rails and can further guide the utensils 20 into position and can help the stack 56 remain in a stacked orientation or if positioned close enough, the first portion 28 can be positioned between the rails 46.

FIG. 6 depicts a cut away elevation view of the dispense chassis 18 showing a plurality or stack 56 of utensils 20 disposed therein. The dispense chassis 18 can include a utensil stack gauge 58 that can indicate a quantity of utensils 20 in stack 56 in the housing 38. The utensil stack gauge 58 can include a first gauge arm 60 which can be pivotally connected to the housing 38 with a pivot 62, and a second gauge arm 64 which can be pivotally connected to the housing 38 with a pivot 66. The utensil dispenser 10 can include one or more gauge windows 68 (FIGS. 1 and 2) through which the dispense chassis 18 can indicate quantities of utensils 20 in the dispense chassis 18. The second gauge arm 64 can include an indicator portion 70 which can display different quantities of utensils 20 through the gauge window 68. The first gauge arm 60 can include a gear 72, and the second gauge arm 64 can include a gear 74 which can mesh with the gear 72 so that movement of the first gauge arm 60 about the pivot 62 can be translated to movement of the second gauge arm 64 about the pivot 66 to move the indicator portion 70 relative to the gauge window 68. Gear 72 and gear 74 can also be a Scotch yoke. In an alternative embodiment that is not shown, the first gauge arm and the second gauge arm can be fixed together and can pivot such that movement of the first gauge arm about the pivot can be translated into movement of the second gauge arm to move the indicator portion relative to the gauge window.

The indicator portion 70 can display different quantities of utensils 20 through the gauge window 68. The indicator portion 70 can have different quantities printed on different parts of the indicator portion 70. The different quantities can be visible through the gauge window 68 one at a time or multiple quantities can be displayed to show that the level is between the quantities displayed. For example, the indicator portion 70 could have "Full" and/or a green color printed on the indicator portion 70 that is visible through the gauge window 68 when the dispense chassis 18 has more than a certain amount of utensils 20 in the utensil stack 56, more than 50% full, more than 60% full, more than 70% full more than 80% full, or more than 90% full; "Half-Full" and/or a yellow color printed on the indicator portion that is visible through the gauge window 68 when the dispense chassis 18 has between certain amounts of utensils 20 in the utensil stack 56, between 10% full and 90% full, between 20% full and 80% full, between 30% full and 70% full, between 40% full and 60% full; and/or "Empty" and/or a red color printed on the indicator portion 70 that is visible through the gauge window 68 when the dispense chassis 18 has less than a certain amount of utensils 20, less than 5, less than 4, less than 3, less than 2, or no utensils 20 in the utensil stack 56. Alternatively, the colors can be used to indicate how many full stacks of utensils (the number of utensils in a full stack of utensils can vary) can be added to the dispense chassis 18. For example, where a full stack of utensils is thirty utensils, green may indicate that less than one full stack of additional utensils 20 will fit within the dispense chassis 18. Yellow can indicate that more than one full stack of additional utensils can be added to the dispense chassis 18, and red can indicated that two full stacks of additional utensils can be added to the dispense chassis 18.

The first gauge arm 60 can include 1 prong, 2 prongs, 3 prongs, 4 prongs, 5 prongs, at least 1 prong, at least 2 prongs, at least 3 prongs, at least 4 prongs, or at least 5 prongs. The first gauge arm can include a first prong 78 and a second prong 80. The housing 38 can include a first gauge opening 82 through which the first prong 78 can extend and can include a second gauge opening 84 through which the second prong 80 can extend. The utensil stack 56 in the dispense chassis 18 shown in FIG. 6 is higher than the first gauge opening 82. When the utensil stack 56 is at or above the first gauge opening 82, the first prong 78 contacts the utensils 20 in the utensil stack 56 through the first gauge opening 82 and the contacted utensil or utensils prevent the first prong 78 from extending through the first gauge opening 82. The first prong 78 contacting the utensils 20 sets the first gauge arm 60 at a first angle and positions the second gauge arm 64 so that the indicator portion 70 indicates a corresponding quantity of utensils 20 in the dispense chassis 18 through the gauge window 68. In this position, the second gauge arm 64 can position the indicator portion 70 so that the indicator portion 70 visible through the gauge window 68 indicates that the dispense chassis is "Full".

Figure 7:
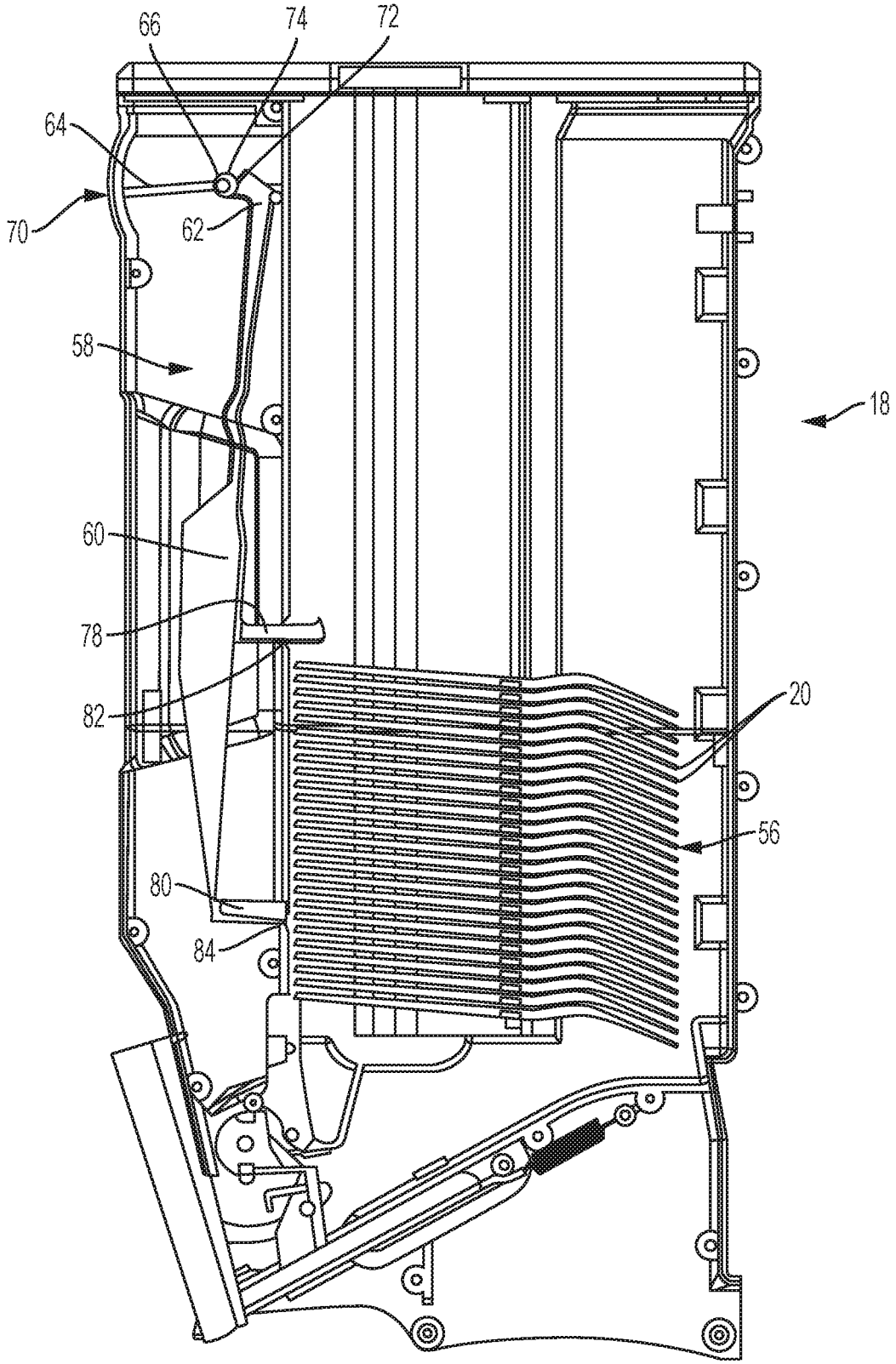
FIG. 7 depicts another illustrative cut away side view of the illustrative dispense chassis in which the dispense chassis is between half-full and empty of utensils, according to one or more embodiments.

FIG. 7 depicts the dispense chassis 18 shown in FIG. 6 in which the dispense chassis 18 is between half-full and empty of utensils 20. Since the utensil stack 56 is lower than the first gauge opening 82 and higher than the second gauge opening 84, the first prong 78 can extend above the utensil stack 56 and the second prong 80 cannot extend through the second gauge opening 84 into the housing 38. The utensil stack 56 is above the second gauge opening 84 so the second prong 80 contacts one or more of the utensils 20 through the second gauge opening 84 and sets the first gauge arm 60 at a second angle that is rotated relatively counterclockwise (as shown in FIG. 7) in comparison to the position of the first gauge arm 60 as shown in FIG. 6. In this position, the second gauge arm 64 can position the indicator portion 70 so that the indicator portion 70 visible through the gauge window 68 indicates that the dispense chassis is "Half-Full" or less than half-full.

Figure 8:
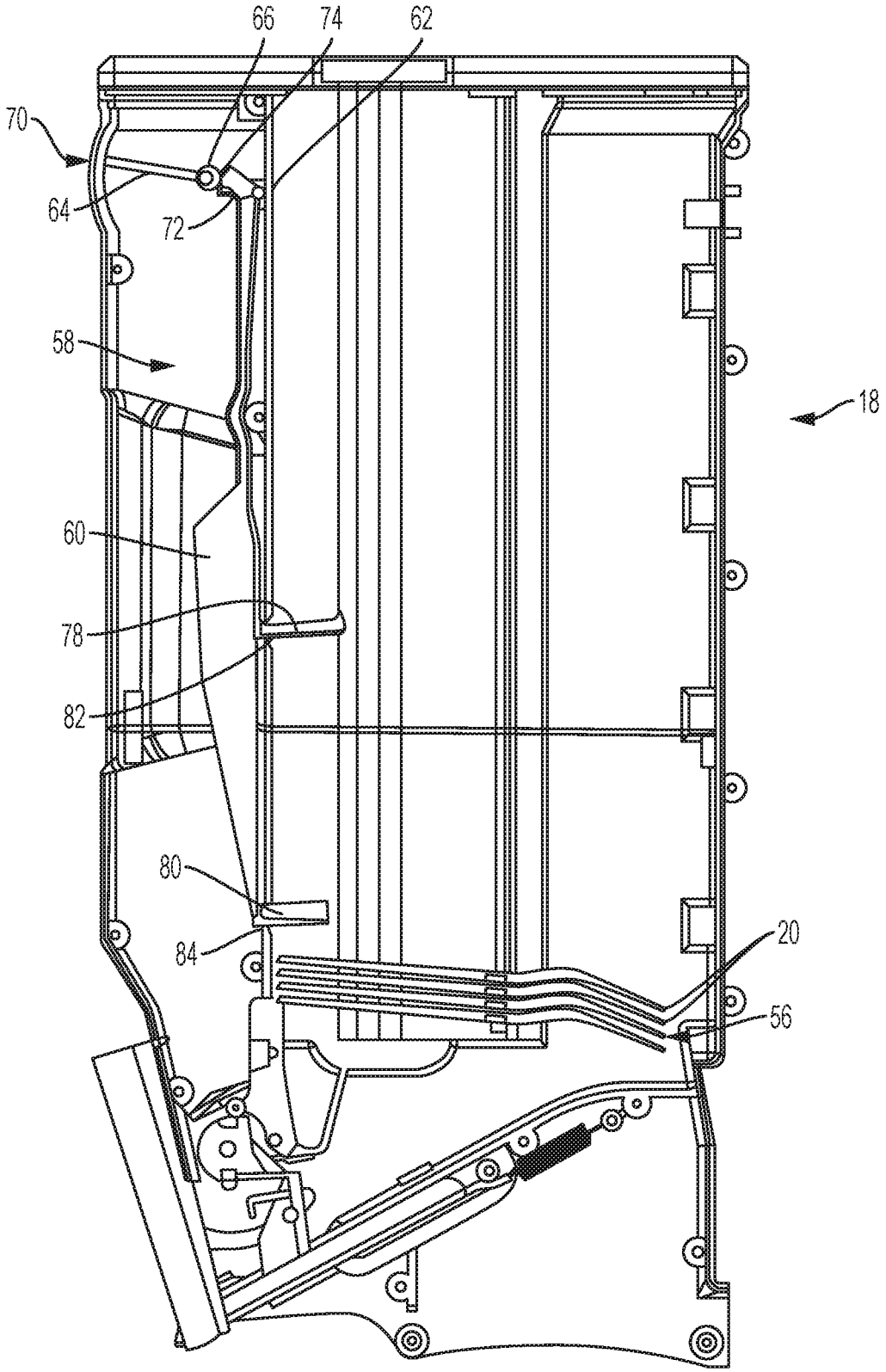
FIG. 8 depicts another illustrative cut away side view of the illustrative dispense chassis in which the dispense chassis is almost empty of utensils, according to one or more embodiments.

FIG. 8 depicts the dispense chassis 18 shown in FIG. 6 in which the dispense chassis 18 is almost empty of utensils 20. The utensil stack 56 is lower than the second gauge opening 84 so the first prong 78 can extend into the housing 38 through the first gauge opening 82 and the second prong 80 can extend into the housing 38 through the second gauge opening 84. When the second prong 80 can extend into the housing 38, the first gauge arm 60 can rotate relatively counterclockwise (as shown in FIG. 8) in comparison to the positions of the first gauge arm 60 shown in FIGS. 6 and 7. In this position, the second gauge arm 64 positions the indicator portion 70 so that the indicator portion 70 visible through the gauge window 68 indicates that the dispense chassis is "Empty."

The gauge window 68 can be about 5 mm high and can display colors, numbers, percentages, or any other indicator to indicate the number of utensils 20 in the dispense chassis 18. The first gauge arm 60 can swing with gravity with or without a spring assistance. The weight and/or the center of gravity of the first gauge arm 60 can be adjusted to change how the utensil stack gauge 58 operates. The position and/or the number of the prongs can be adjusted to provide more precise level indicators. Additionally, in an embodiment not shown, the first gauge arm 78 can be partially or completely inside the housing 38 such that the first prong 78, the second prong 80, or both the first prong 78 and second prong 80 can directly contact the utensil stack 56 without passing through an opening in the housing 38.

Figure 9:
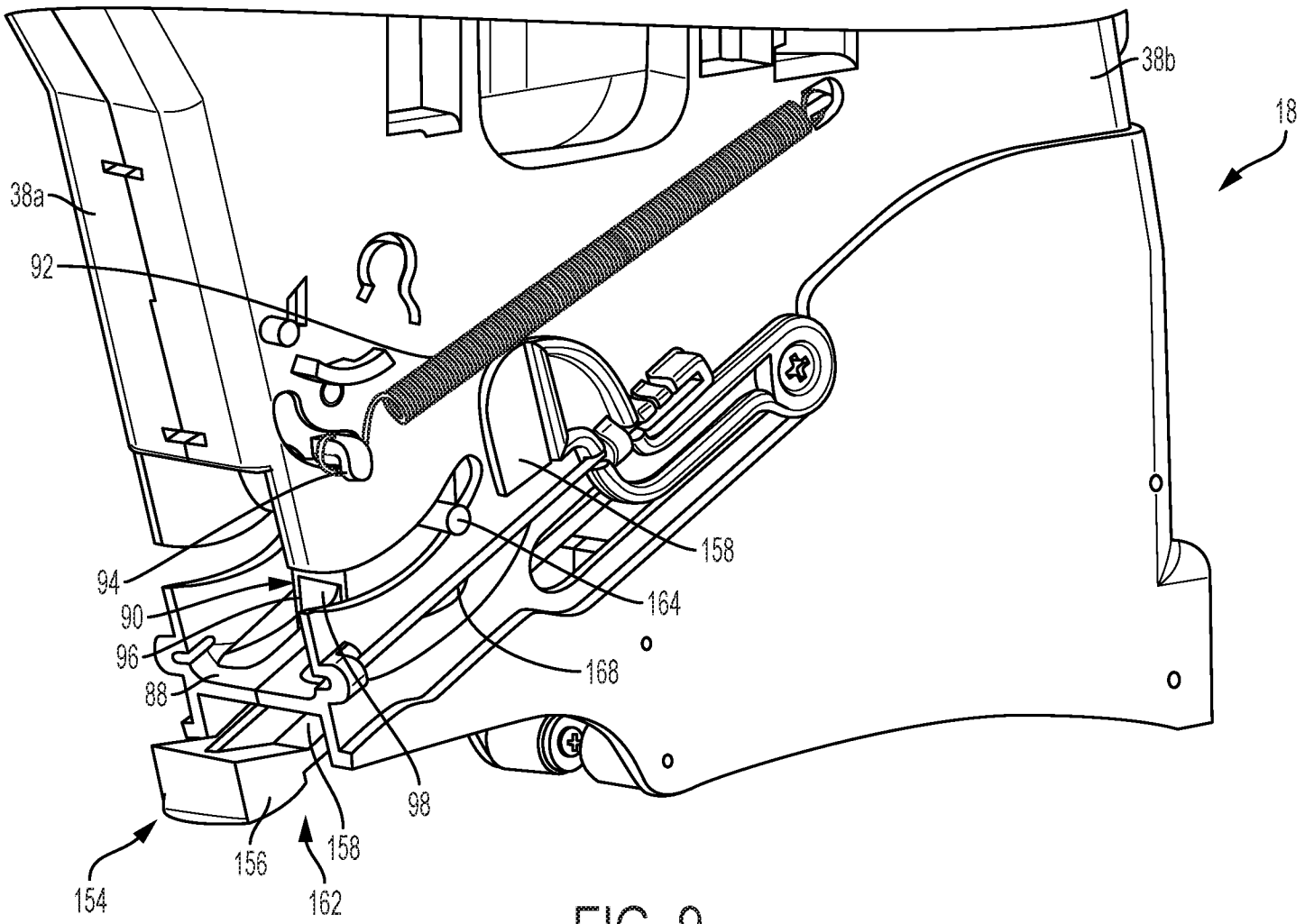
FIG. 9 depicts a partial perspective view of a lower portion of the illustrative dispense chassis, according to one or more embodiments.

FIG. 9 depicts a partial perspective view of the dispense chassis 18 shown in FIG. 2. The dispense chassis 18 can include a ramp 88, an actuator 90 and an actuator return spring 92 which can be connected between an actuator return spring pin 94 and the housing 38*b*. The actuator 90 can include an actuator lever 96 which can include an actuator lever opening 98. The actuator lever opening 98 can be sized to permit passage of the handle 24 of the utensil 20 as the utensil 20 moves down the ramp 88. The actuator lever opening 98 can be sized to contact the first portion 28 or head 34 of the utensil 20 and to prevent further movement of the utensil 20 down the ramp 88 under the force of gravity. In one or more examples, the actuator lever opening can have a generally upside down "U" shape and can taper from relatively larger to relatively smaller in the downward direction of the ramp 88. In one or more examples, the actuator lever opening 98 can be sized to contact wings or detents 32 on one or both sides of the utensils 20.

Figure 10:
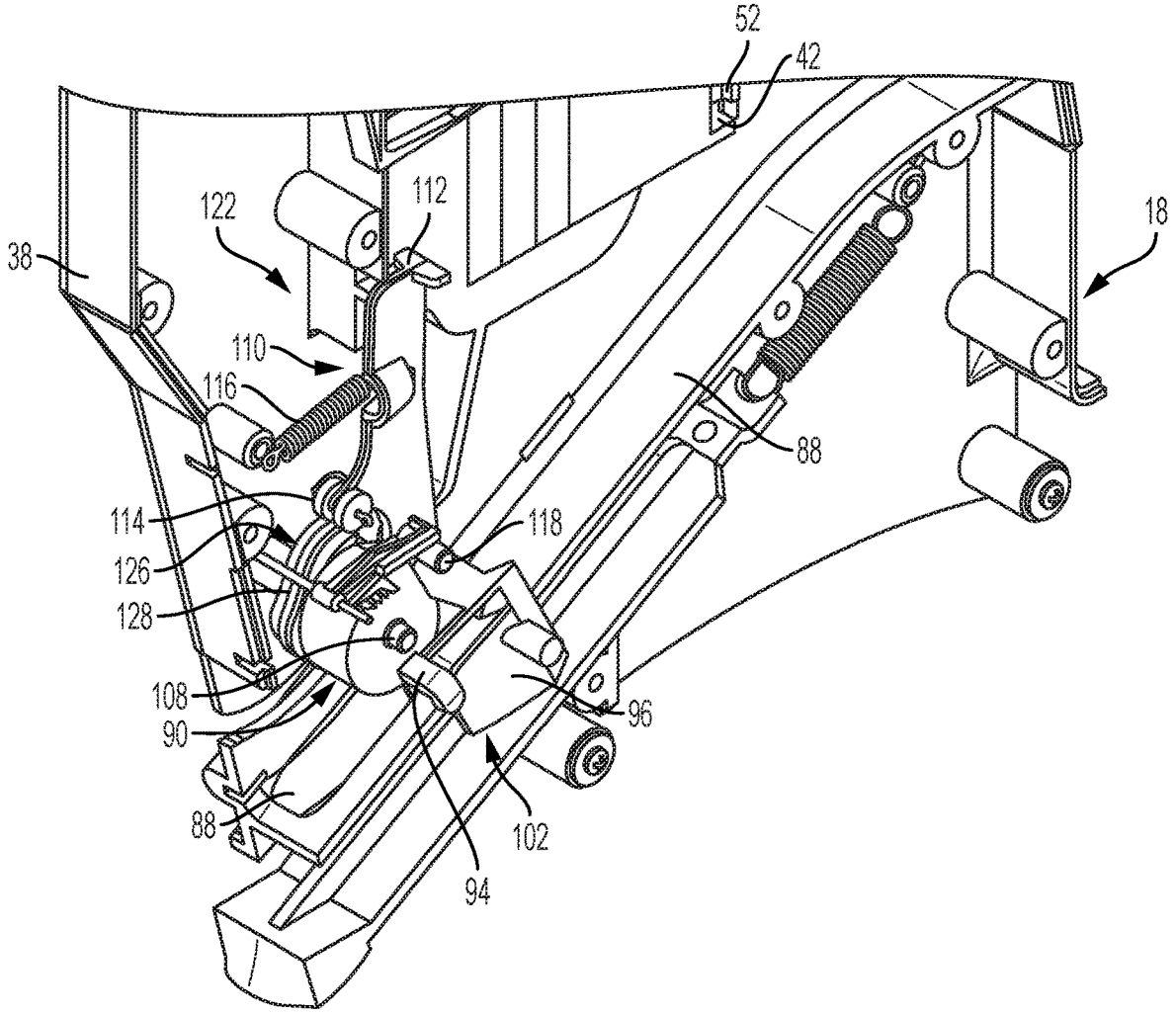
FIG. 10 depicts a partial cut away perspective view of the lower portion of the illustrative dispense chassis showing an enlarged view of its internals with the actuator in a holding position, according to one or more embodiments.
Figure 11:
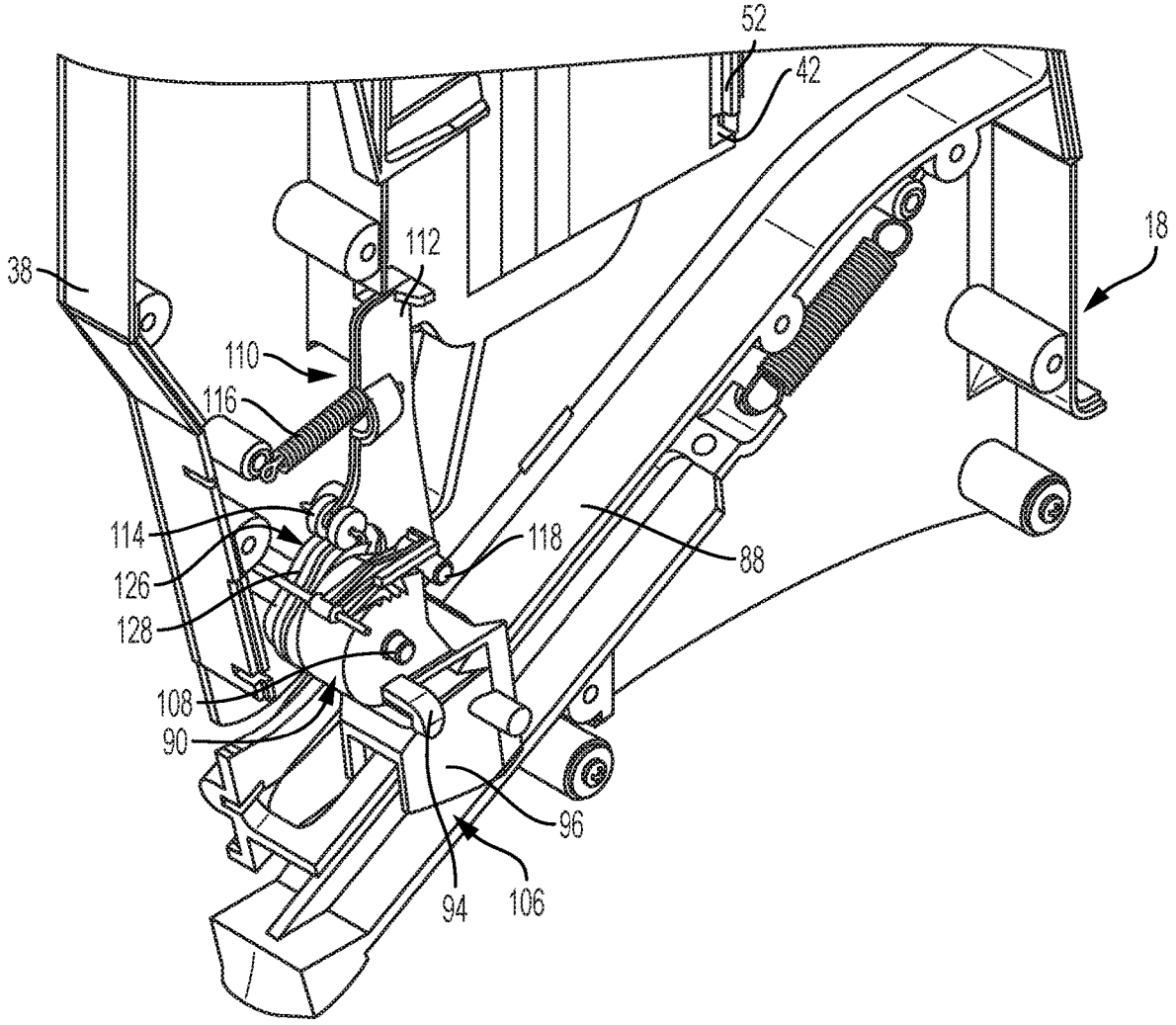
FIG. 11 depicts a partial cut away perspective view of the lower portion of the illustrative dispense chassis showing an enlarged view of its internals with the actuator in a partially dispensing position, according to one or more embodiments.
Figure 12:
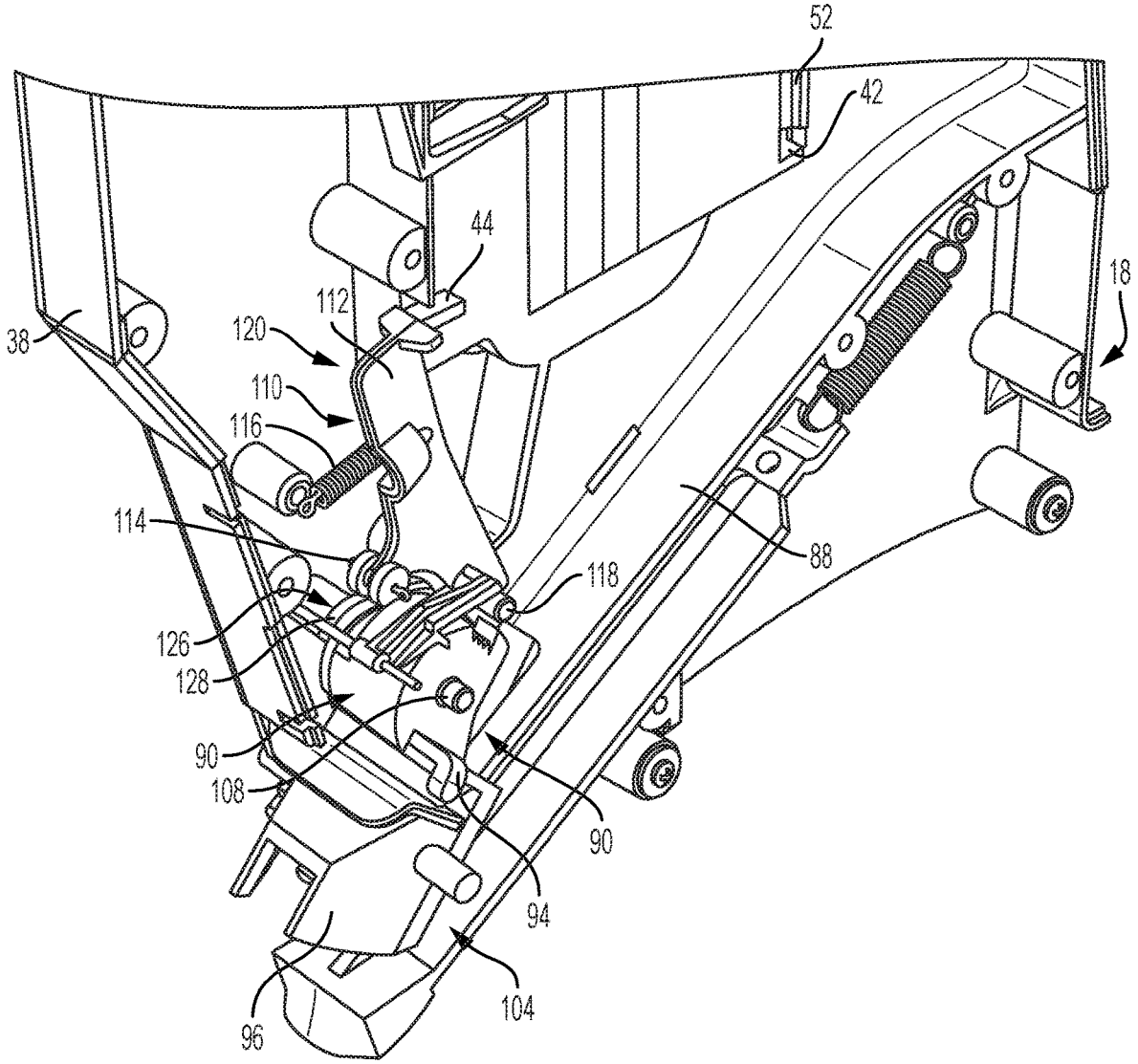
FIG. 12 depicts a partial cut away perspective view of the lower portion of the illustrative dispense chassis showing an enlarged view of its internals with the actuator in a dispensing position, according to one or more embodiments.
Figure 13:
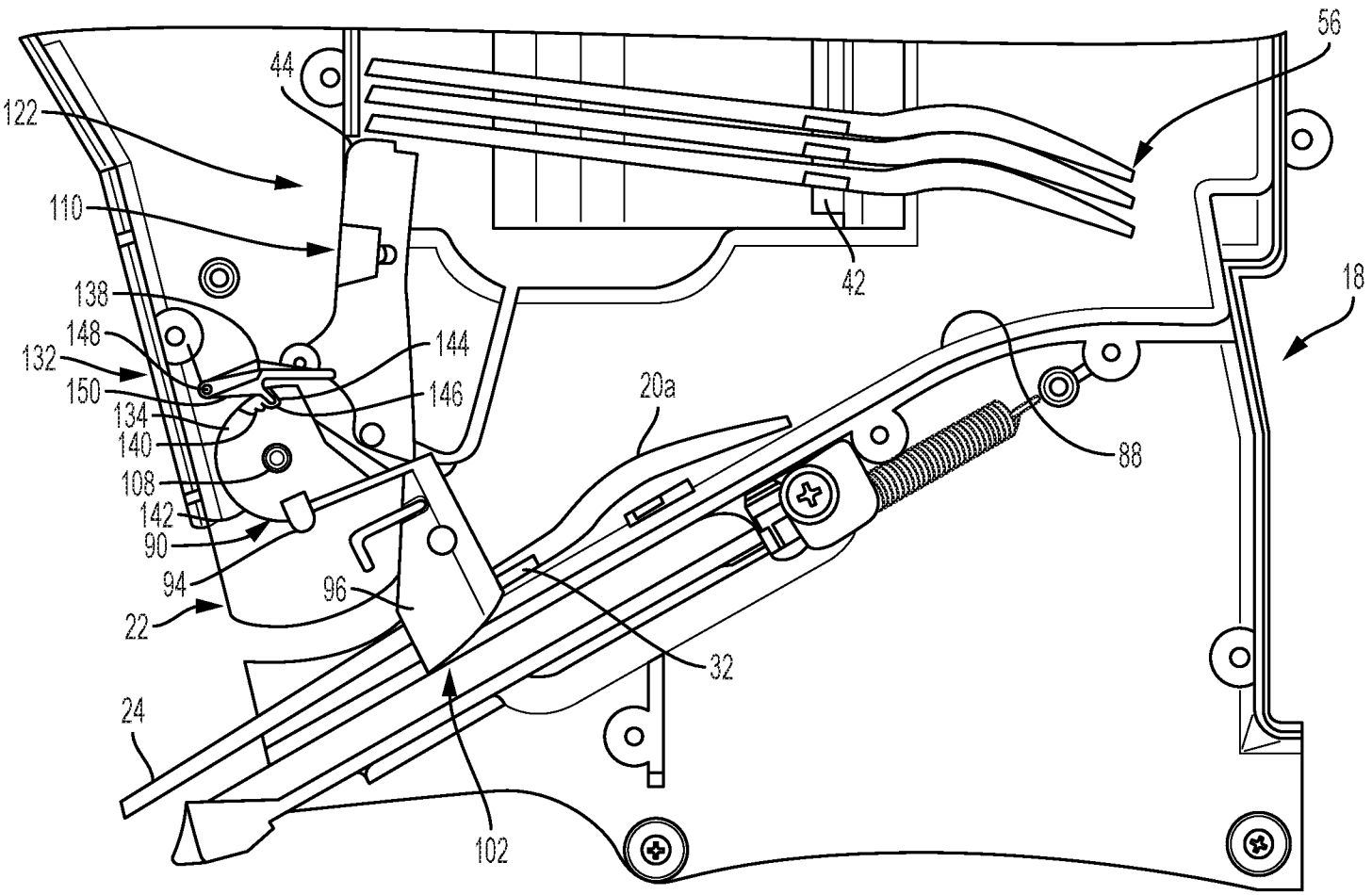
FIG. 13 depicts illustrative cut away side view of the lower portion of the illustrative dispense chassis to better illustrate the actuator in the holding position, according to one or more embodiments.

FIGS. 10-12 depict partial cut away perspective views of the dispense chassis 18. The actuator 90 can move between a holding position 102 (FIG. 10), a dispensing position 104 (FIG. 12), and a partially dispensing position 106 (FIG. 11) which can be between the holding position 102 and the dispensing position 104. The actuator 90 can be pivotally mounted to the housing 38 with a pivot 108 and the actuator 90 can rotate around the pivot 108 between the holding position 102 and the dispensing position 104.

The dispense chassis 18 can include a drive mechanism 110 which can have a drive hammer 112, a cam follower 114, and a bias spring 116 connected between the drive hammer 112 and the housing 38. The drive hammer 112 can be mounted to the housing 38 with a pivot 118 around which the drive hammer 112 can rotate to position the drive mechanism 110 between a ready position 120 (FIG. 12) and a release position 122 (FIG. 10). The pivot 118 can be any shaft, pin, or axle on which the drive hammer 112 can pivot or rotate.

The actuator 90 can include a cam 126 which can include a cam surface 128. The cam follower 114 of the drive mechanism 110 can contact and ride on the cam surface 128 as the actuator 90 moves between the holding position 102 and the dispensing position 104. Movement of the actuator 90 between the holding position 102 and the dispensing position 104 can actuate the drive mechanism 110 through the cam 126 and cam follower 114. When actuated, the drive mechanism 110 can move between the ready position 120 in which the drive hammer 112 has been retracted and is ready to drive the bottom utensil 21 from the utensil stack 56, and the release position 122 in which the drive hammer 112 contacts and pushes the bottom utensil 21 from the utensil stack 56.

FIGS. 13-16 depict elevation partial cut away views of the dispense chassis 18. In the holding position 102 (FIGS. 10 and 13) the actuator 90 can receive the released utensil 20*a* after it has been released from stack 56 by the drive mechanism 110 via the ramp 88 and the actuator lever 96 can contact the released utensil 20*a* to arrest the movement of the released utensil 20*a* down the ramp 88. The actuator lever 96 can contact the detents 32 or head 34 of the released utensil 20*a*. In the holding position 102, the actuator 90 can hold the released utensil 20*a* such that the handle 24 is accessible via the access port 22 (FIGS. 1 and 13) where the released utensil 20*a* is in a dispense position. When the actuator 90 is in the holding position 102, the drive mechanism 110 can be in the release position 122. In the partially dispensing position 106 (FIGS. 11 and 14), the actuator 90 can be rotated and the utensil 20*a* can move further out of the access port 22. In the partially dispensing position 106, the actuator 90 can refrain from immediately returning to the holding position 102 if the handle 24 is released. In the dispensing position 104 (FIGS. 12 and 15) the actuator 90 can release the released utensil 20*a* as the user pulls the released utensil 20*a* free from the utensil dispenser 10 and the drive mechanism 110 can move to the ready position 120.

When or as the actuator 90 returns from the dispensing position 104 to the holding position 102 (FIG. 16), the drive mechanism 110 can move from the ready position 120 to the release position 122 and the bottom utensil 21 can be moved or pushed from the bottom of the utensil stack 56. The drive mechanism 110 can push the bottom utensil 21 so that the first portion 28 of the bottom utensil 21 clears the front pedestal 42 and second portion 30 of the bottom utensil 21 clears the rear pedestal 44, which can allow the bottom utensil 21 to fall from the utensil stack 56. When the bottom utensil 21 is moved or pushed from the bottom of the utensil stack 56 (FIG. 16), the bottom utensil 21 can fall to the ramp 88 and can slide or move down the ramp 88 to the actuator 90 under the force of gravity. When the bottom utensil 21 is pushed from the bottom of the utensil stack 56, the utensil stack 56 can move down creating a new bottom utensil 21.

Figure 14:
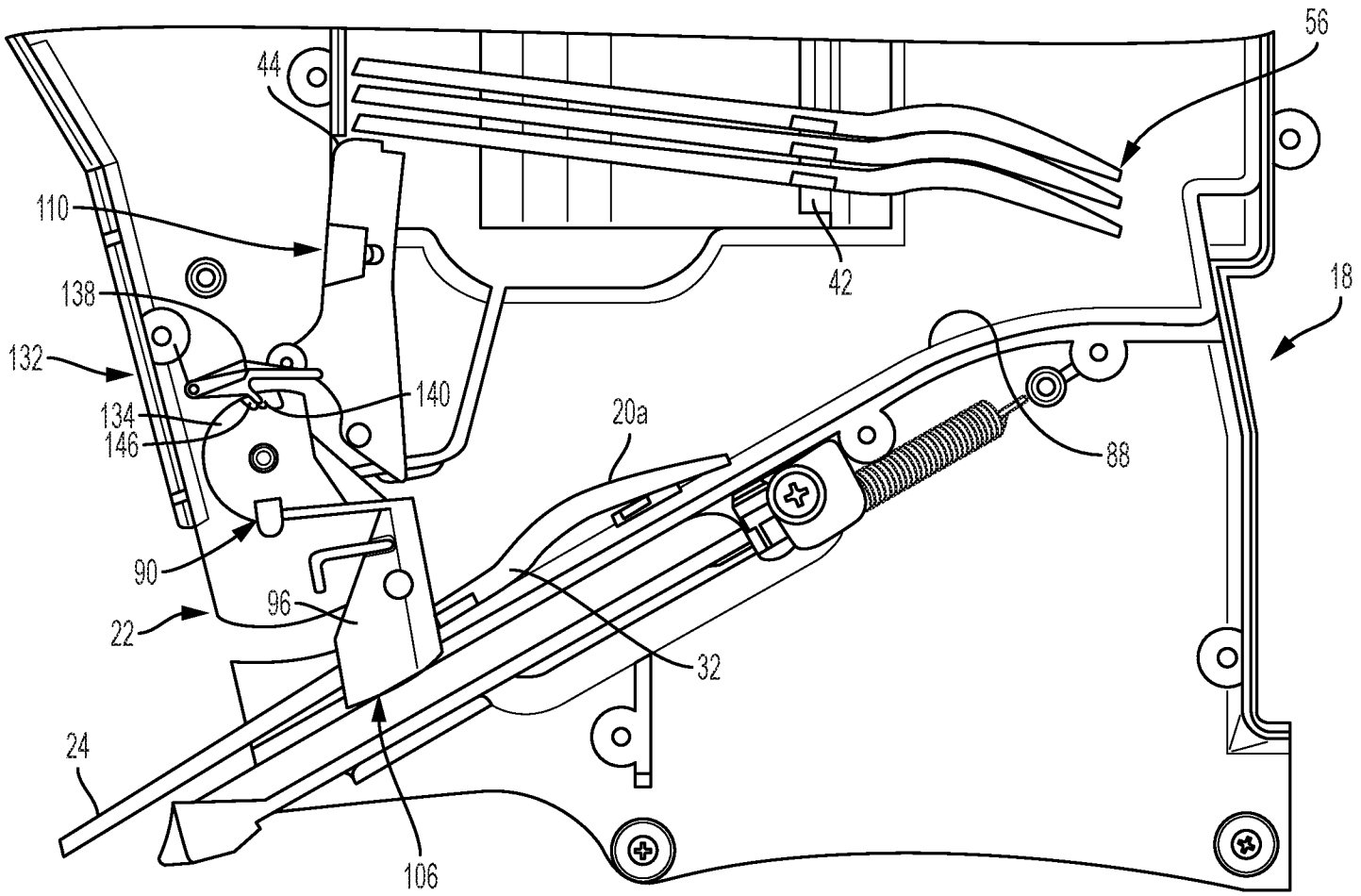
FIG. 14 depicts an illustrative cut away side view of the lower portion of the illustrative dispense chassis to better illustrate the actuator in the partially dispensing position, according to one or more embodiments.
Figure 15:
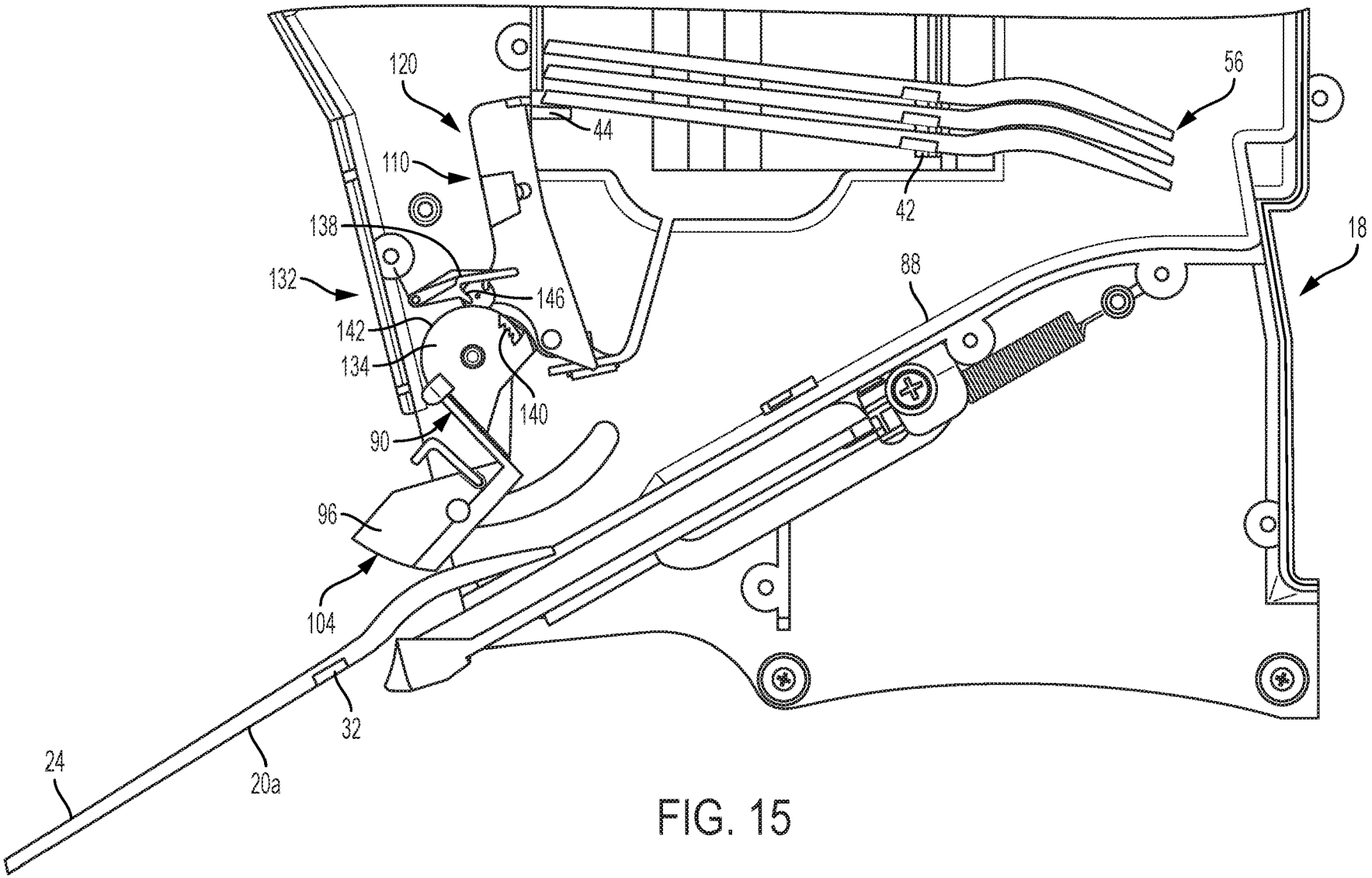
FIG. 15 depicts the drive mechanism in a ready to dispense position, according to one or more embodiments.

Referring again to FIGS. 13-16, the dispense chassis 18 can include a ratchet gear assembly 132. The ratchet gear assembly 132 can include a ratchet gear 134 which can be connected to the actuator 90, or can be integral with the actuator 90. The ratchet gear assembly 132 can prevent the actuator 90 from kicking back as the actuator 90 is partially moved from the holding position 102 (FIGS. 10 and 13), toward the dispensing position 104 (FIGS. 12 and 15), and to the partially dispensing position 106 (FIGS. 11 and 14). The ratchet gear 134 can be connected to or integral with the actuator cam 126 (FIGS. 10-12) so that the ratchet gear 134 rotates around the pivot 108 with the actuator cam 126. The ratchet gear 134 can be formed as part of the actuator 90 and can be positioned at least partially within the housing 38. The actuator return spring pin 94 can extend from the ratchet gear 134 and the return spring 92 (FIG. 9) can bias the actuator 90 in the holding position 102 through the ratchet gear 134 and can return the actuator 90 from the dispensing position 104 to the holding position 102.

The ratchet gear assembly 132 can include a ratchet pawl 138 and the ratchet gear 134 can include ratchet teeth 140, a surface 142, and a stop 144. The ratchet pawl 138 can include a ratchet pawl hook 146 and can be pivotally connected to the housing 38 with a pivot 148. The ratchet gear assembly 132 can include a ratchet pawl spring 150 which can bias the ratchet pawl hook 146 in contact with the ratchet gear 134.

The ratchet pawl hook 146 can engage the stop 144 to stop the actuator 90 at the holding position 102 (FIGS. 10 and 13) and can prevent the actuator 90 from rotating past the holding position 102 when moving from the dispensing position 104. The ratchet pawl hook 146 can engage the ratchet teeth 140 in the first part of the movement of the actuator 90 from the holding position 102 to the partially dispensing position 106 (FIGS. 11 and 14) to prevent the actuator lever 96 from kicking back if the user releases the utensil handle 24 after beginning to pull but before the utensil 20 is released from the utensil dispenser 10.

The ratchet pawl hook 146 can engage the surface 142 to move the ratchet pawl hook 146 from the ratchet teeth 140 as the actuator 90 is moved to the dispensing position 104 (FIGS. 12 and 15) and the released utensil 20*a* is removed from the utensil dispenser 10. After the released utensil 20*a* is removed, the actuator 90 can return to the holding position 102 under the force of the return spring 92 (FIG. 9) and the ratchet pawl hook 146 can catch the stop 144 to position the actuator 90 in the holding position 102.

Figure 16:
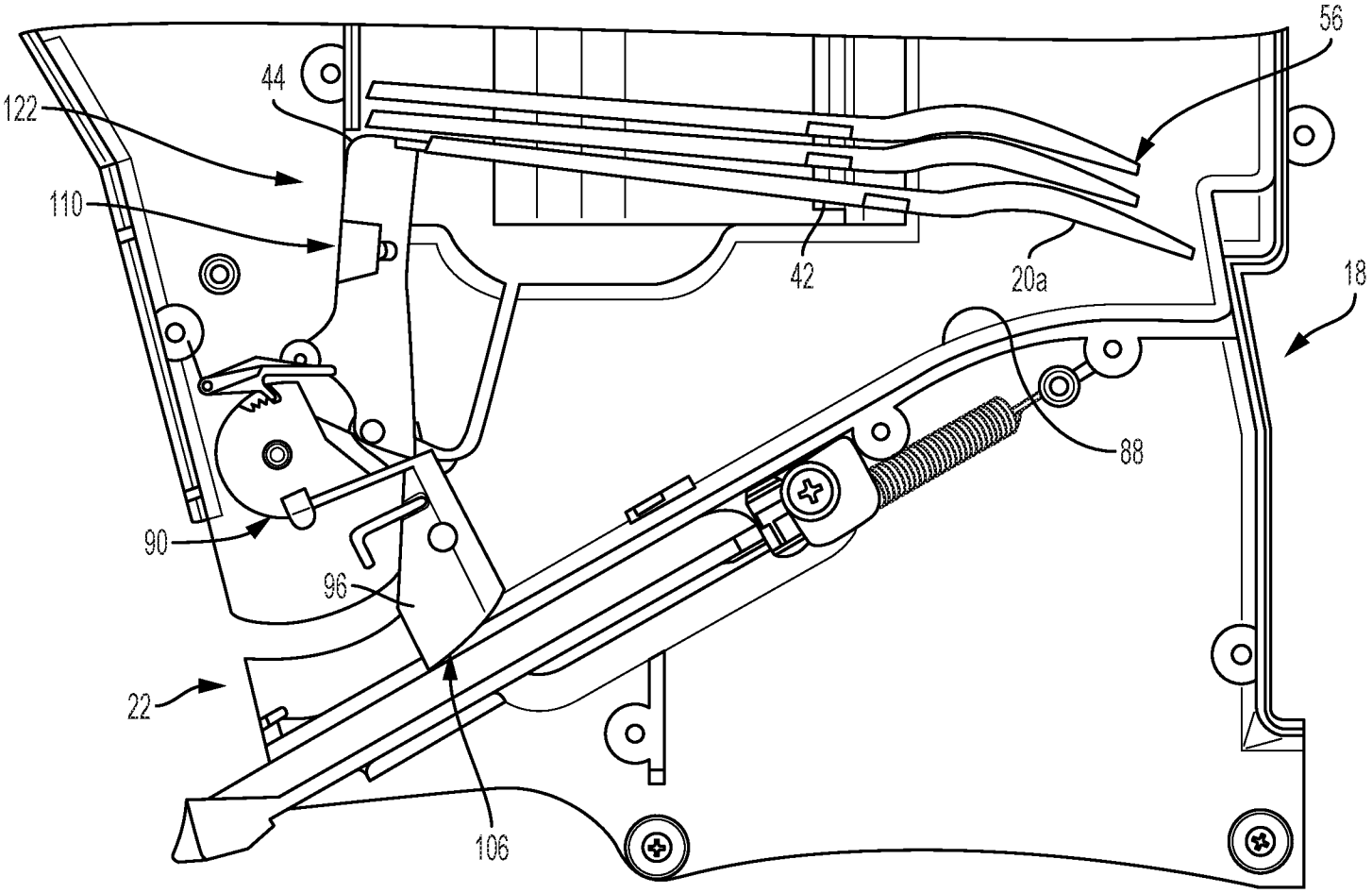
FIG. 16 depicts the drive mechanism in a holding or resting position, according to one or more embodiments.
Figure 17:
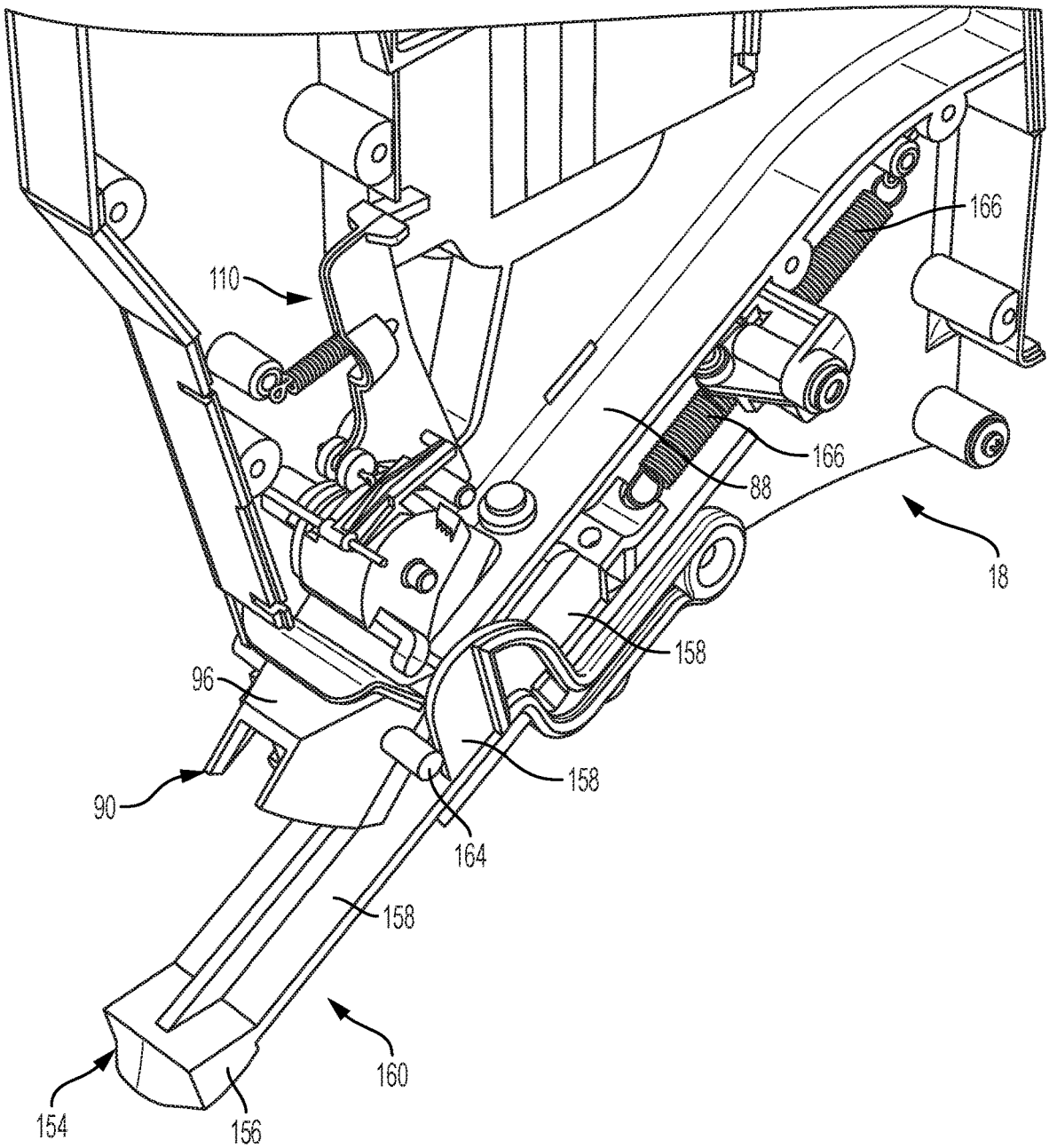
FIG. 17 depicts a partial cut away perspective view of the illustrative dispense chassis and a prime mechanism disposed therein, according to one or more embodiments.

FIG. 17 depicts a partial cut away perspective view of the dispense chassis 18 shown in FIG. 2 with a prime mechanism 154. The dispense chassis 18 can include the prime mechanism 154 for actuating the drive mechanism 110 to remove a bottom utensil 21 from the utensil stack 56 (as shown in FIG. 16) to deliver the bottom utensil 21 to the actuator 90 when the actuator 90 is not already holding a released utensil 20*a*. The prime mechanism 154 can be positioned, at least partially below the access port 22 (FIG. 1). The prime mechanism 154 can include a primer handle 156 and a primer arm 158. The primer arm 158 can be connected to or form part of the primer handle 156. The prime mechanism 154 can move between an extended position 160 (FIG. 17), in which the drive mechanism 110 is moved to the ready position 120 (FIG. 12), and a rest position 162 (FIGS. 9 and 16), in which the drive mechanism 110 is moved to the release position 122 (FIG. 10) and moves the bottom utensil 21 from the utensil stack 56 to fall to the ramp 88 and the actuator lever 96. In one or more examples, the primer handle 156 can be moved from the rest position 162 to the extended position 160 using a pulling force.

The actuator lever 96 can include a actuator pin 164 and the primer arm 158 can engage the actuator pin 164 to move the actuator 90 from the holding position 102 to the dispensing position 104 by moving the prime mechanism 154 from the rest position 162 to the extended position 160 by pulling the primer handle 156 and then releasing the primer handle 156. In one or more examples, the actuator return spring 92 (FIG. 9) can return the actuator 90 back to the holding position 102 and the actuator pin 164 can push the primer arm 158 and the primer handle 156 back to the rest position 162. The prime mechanism 154 can include a primer return spring 166 connected between the primer arm 158 and the housing 38 to return the prime mechanism 154 from the extended position 160 to the rest position 162.

The prime mechanism 154 can include one or more guides 168 (FIG. 9) for guiding the primer arm 158 between the rest position 162 and the extended position 164. The prime mechanism 154 allows a user to prime the dispense chassis 18 for use by positioning a utensil 20 for dispensing through the access port 22 after the utensil stack 56 is loaded into the housing 38 when there was not already a utensil 20 with the handle 24 extending from the access port 22.

Figure 18:
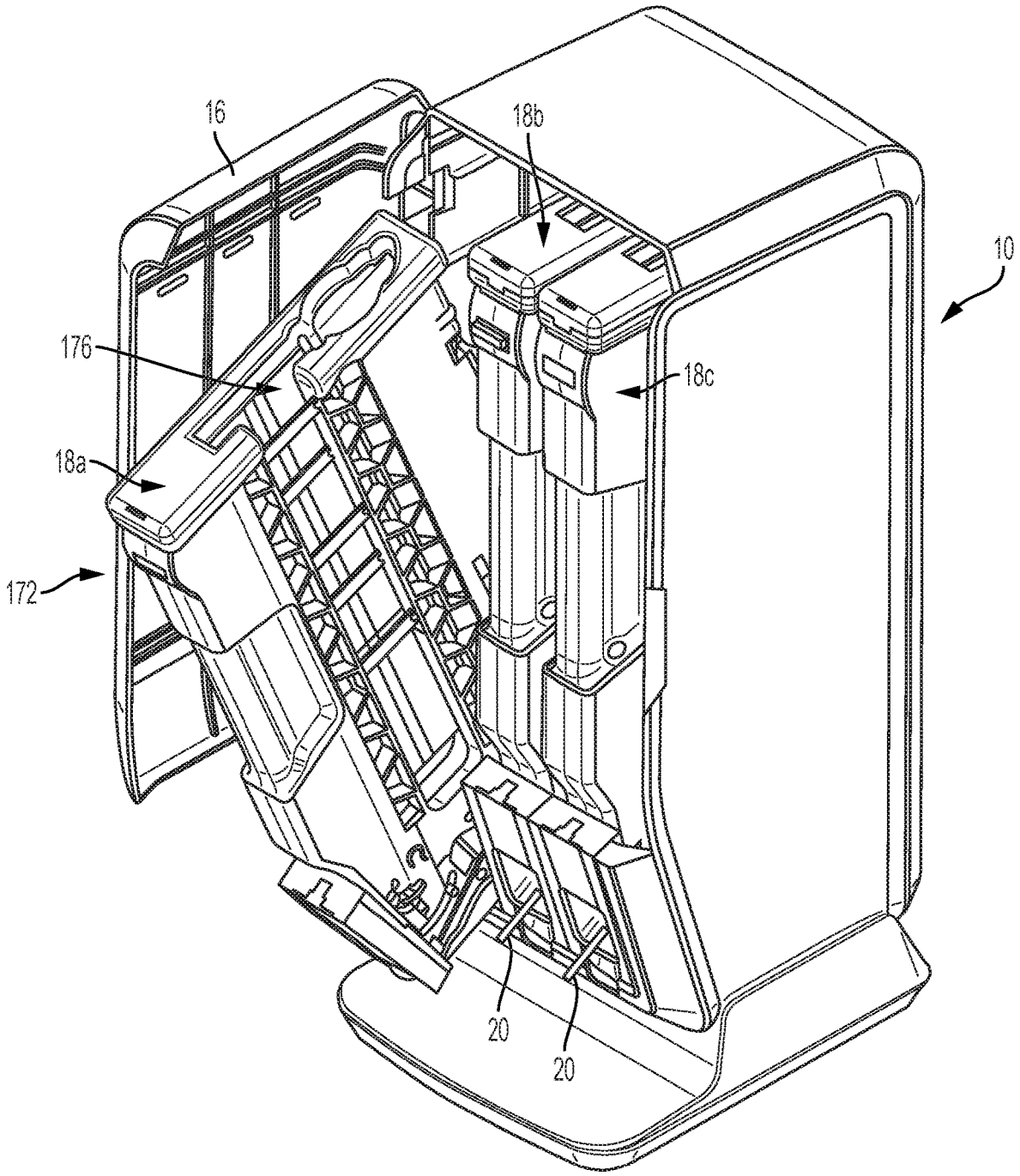
FIG. 18 depicts a perspective view of an illustrative utensil dispenser with the access door open and one dispense chassis in a loading position and two dispense chassis in a dispensing position, according to one or more embodiments

FIG. 18 depicts the utensil dispenser 10 with the access door 16 open and dispense chassis 18*a* in a loading position 172 and dispense chassis 18*b* and 18*c* in a dispensing position 174. When the dispense chassis 18 is in the loading position 172, the utensils 20 can be loaded into the housing 38 through a loading opening 176, and when the dispense chassis 18 is in the dispensing position 174 the utensils 20 can be dispensed from the utensil dispenser 10. The dispense chassis 18 can be moved between the dispensing position 174 and the loading position 172 while remaining connected to the body 12.

Figure 19:
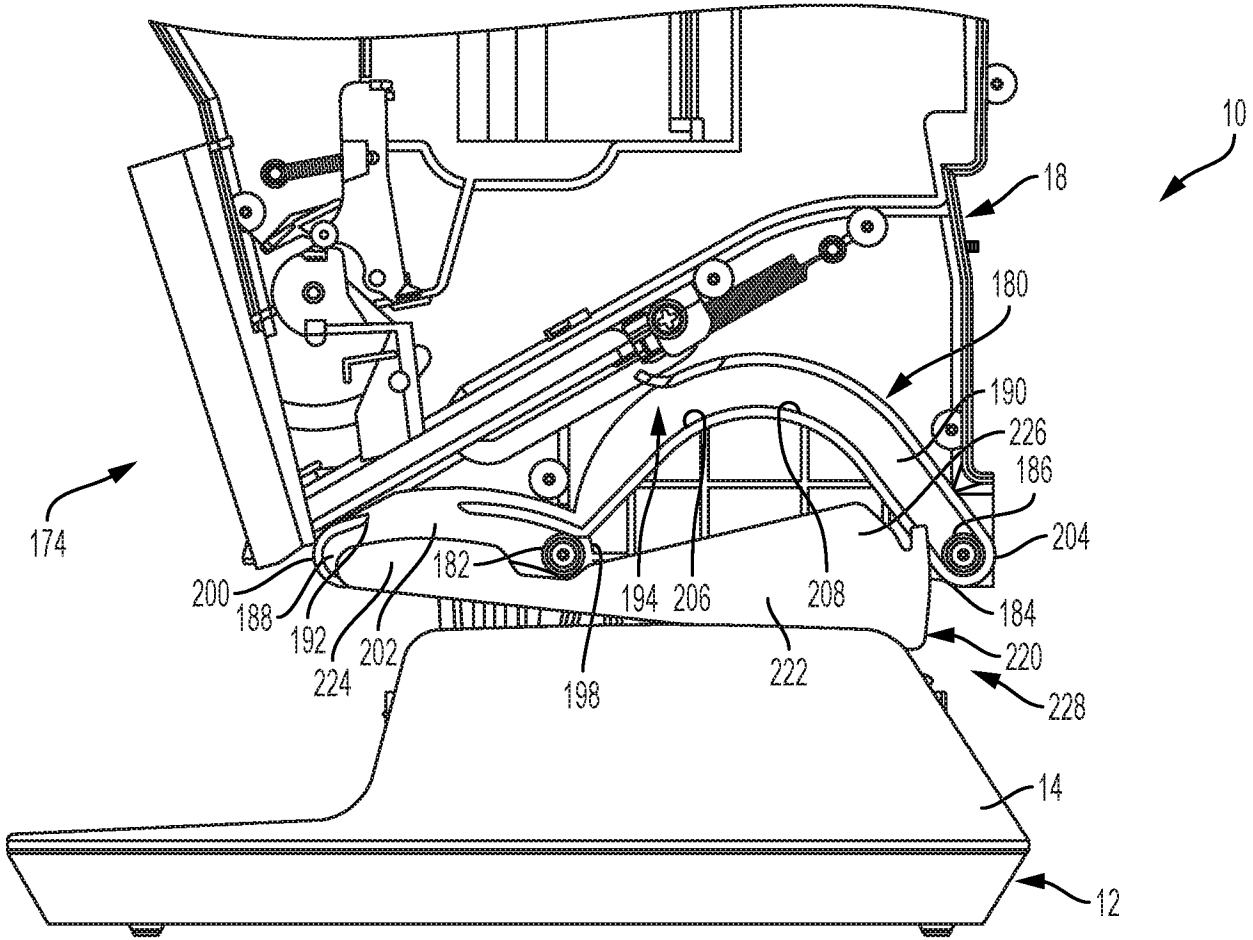
FIG. 19 depicts an illustrative cut away side view of the lower portion of the illustrative dispense chassis to better illustrate the dispense chassis in a dispensing position, according to one or more embodiments.
Figure 20:
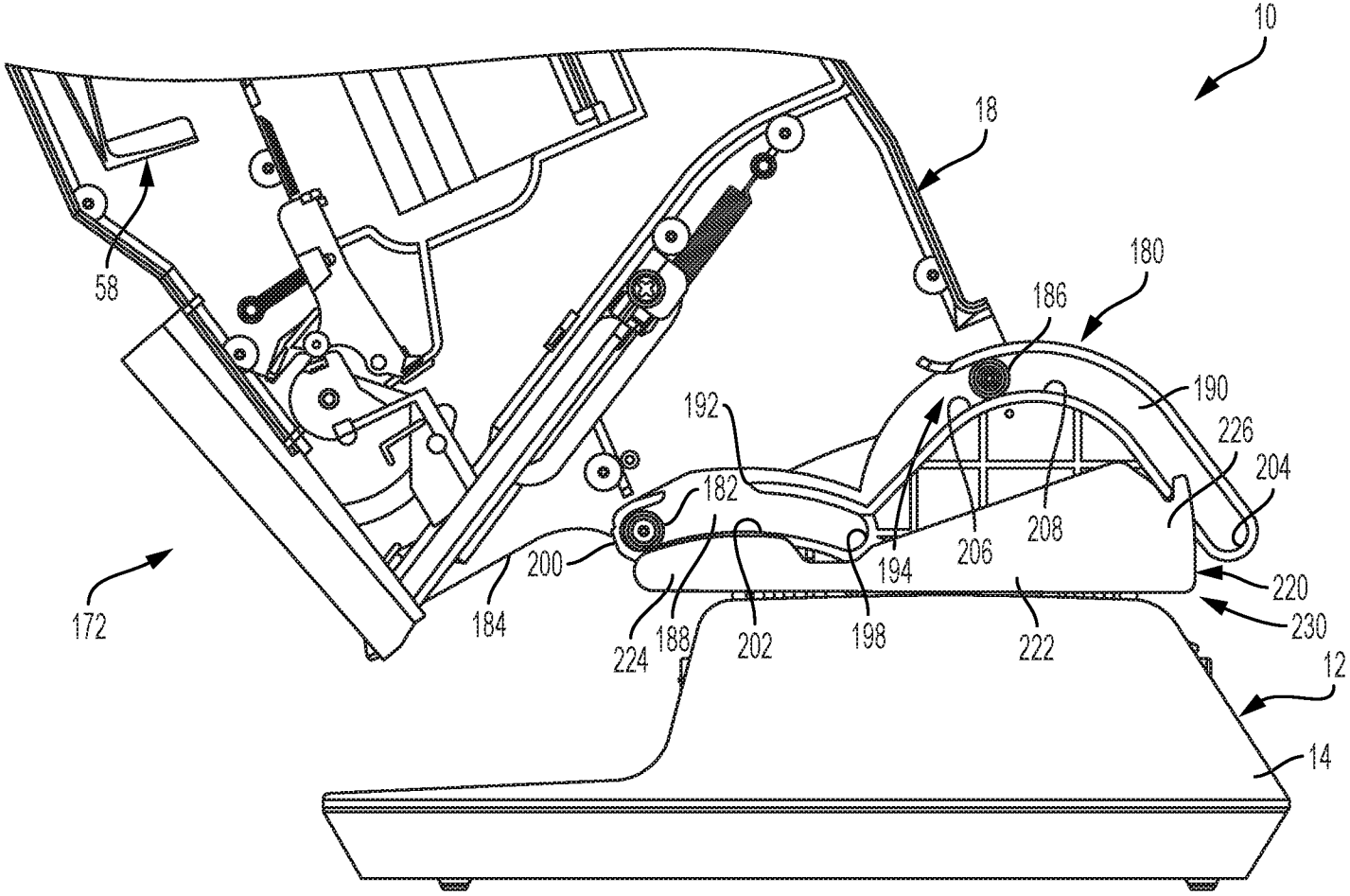
FIG. 20 depicts an illustrative cut away side view of the lower portion of the illustrative dispense chassis to better illustrate the dispense chassis in a loading position, according to one or more embodiments.

FIG. 19 depicts a partial cut away elevation view of portions of the utensil dispenser 10 shown in FIG. 2 with the dispense chassis 18 in the dispensing position 174. FIG. 20 depicts a partial cut away elevation view of the utensil dispenser 10 shown in FIG. 2 with the dispense chassis 18 in the loading position 172. The utensil dispenser 10 can include a dispense chassis support or glide mechanism 180 which can be connected to the base 14 of the body 12 for supporting at least one utensil dispense chassis 18. The dispense chassis 18 can include a first pin 182, which can be connected to or integral with the housing 38, disposed at or near a bottom 184 of the dispense chassis 18. The dispense chassis 18 can include a second pin 186, which can be connected to or be integral with the housing 38, disposed at or near the bottom 184 of the dispense chassis 18 and can be spaced apart from the first pin 182.

The glide mechanism 180 can include one or more slots or channels for guiding each dispense chassis 18. For example, the glide mechanism 180 can include a first slot 188 for engaging the first dispense chassis pin 182 to at least partially support the dispense chassis 18, and a second slot 190 for engaging the second dispense chassis pin 186 to at least partially support the dispense chassis 18. The first pin 182 and/or second pin 186 can be any rounded cylindrical or tubular shaped structures. The first pin 182 and/or second pin 186 can be stationary so that they can slide within the first and second slots 188 and 190. The first pin 182 and/or second pin 186 can roll so that they can roll within the first and second slot 188 and 190. The first and second slots 188 and 190 can be configured to engage the first and second pins 182 and 184. The glide mechanism 180 can support the dispense chassis 18 in the dispensing position 174 (FIG. 19) and in the loading position 172 (FIG. 20). The glide mechanism 180 can also support and guide the dispense chassis 18 between the dispensing position 174 and the loading position 172. The glide mechanism 180 can guide the dispense chassis 18 to tilt outward when in the loading position 172.

The first slot 188 can include an arcuate shape and can guide the first pin 182 in a forward and upward motion as the dispense chassis 18 is moved from the dispensing position 174 to the loading position 172. The dispense chassis 18 can be removed from the glide mechanism 180 and the body 12. The first slot 188 can have a first slot opening 192 through which the first pin 182 can escape the first slot 188 when removing the dispense chassis 18 from the glide mechanism 180. The second slot 190 can include an arcuate shape and can guide the second pin 186 in an arcuate and forward motion. The second slot 190 can include a second slot opening 194 through which the second pin 186 can escape the second slot 190 when removing the dispense chassis 18 from the glide mechanism 180.

The pins 182 and 186 and/or the slots openings 192 and 194 can be spaced such that only one of the pins 182 and 186 can be removed through the slot openings 192 and 194 at a time. The first slot opening 192 can be spaced along the first slot 188 such that the first pin 182 can be removed from the first slot 188 when the dispense chassis 18 is in between the dispensing position 174 and the loading position 176. The pins 182 and 186, and the slot openings 192 and 194 can be arranged to maintain the pins 182 and 186 in the slots 188 and 190 when the dispense chassis 18 is in the dispensing position 174 and the loading position 172. The second slot opening 194 can be positioned in the second slot 190 such that the second pin 186 cannot be removed from the second slot 190 unless the first pin 182 is first removed from the first slot 188.

The first slot 188 can include a first end 198 and a second end 200 and can have a crown 202 which can be relatively higher than the first end 198 and/or the second end 200. The first pin 182 can be located at the first end 198 of the first slot 188 when the dispense chassis 18 is in the dispensing position 174 (FIG. 19), and can be located at the second end 200 of the first slot 188 when the dispense chassis 18 is in the loading position 172 (FIG. 20). The crown 202 can bias the first pin 182 toward the first end 198 or the second end 200 depending on which side of the crown 202 the first pin 182 is located.

The second slot 190 can include a first end 204 and a second end 206 and can have a crown 208 that can be relatively higher than the first end 204 and/or the second end 206. The second pin 186 can be located at the first end 204 of the second slot 190 when the dispense chassis 18 is in the dispensing position 174 (FIG. 19), and can be located on the second end 206 side of the crown 208 when the dispense chassis 18 is in the loading position 172 (FIG. 20). The crown 208 can bias the second pin 186 toward the first end 204 when the second pin 186 is on the first end side of the crown 208, and can bias the second pin 186 toward the second end 206 when the second pin 186 is on the second end side of the crown 208. The biases provided by the first slot crown 202 and the second slot crown 208 can hold the dispense chassis 18 in the dispensing position 174 and the loading position 172. The utensil stack gauge 58 can move out of the way of the loaded utensils 20 when the dispense chassis 18 in the loading position 172 under the force of gravity (FIG. 20).

Figure 21:
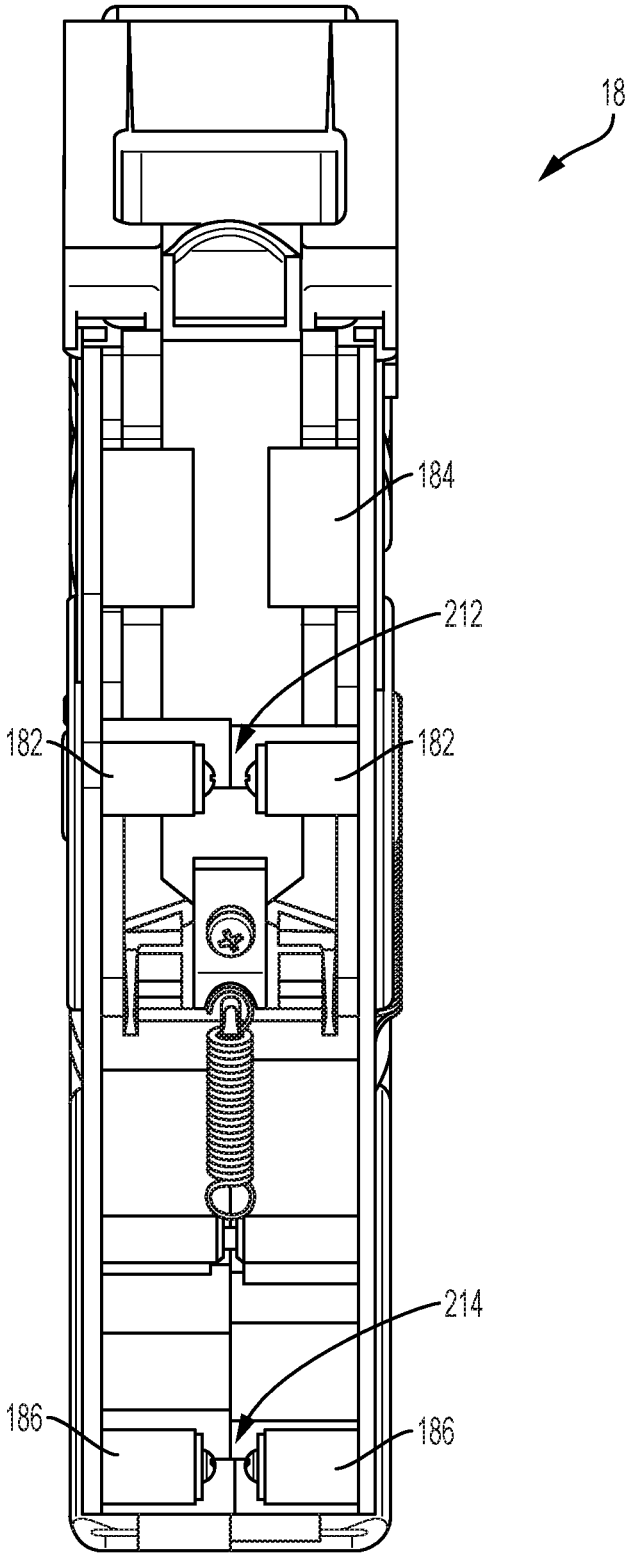
FIG. 21 depicts a bottom view of the illustrative dispense chassis, according to one or more embodiments.
Figure 22:
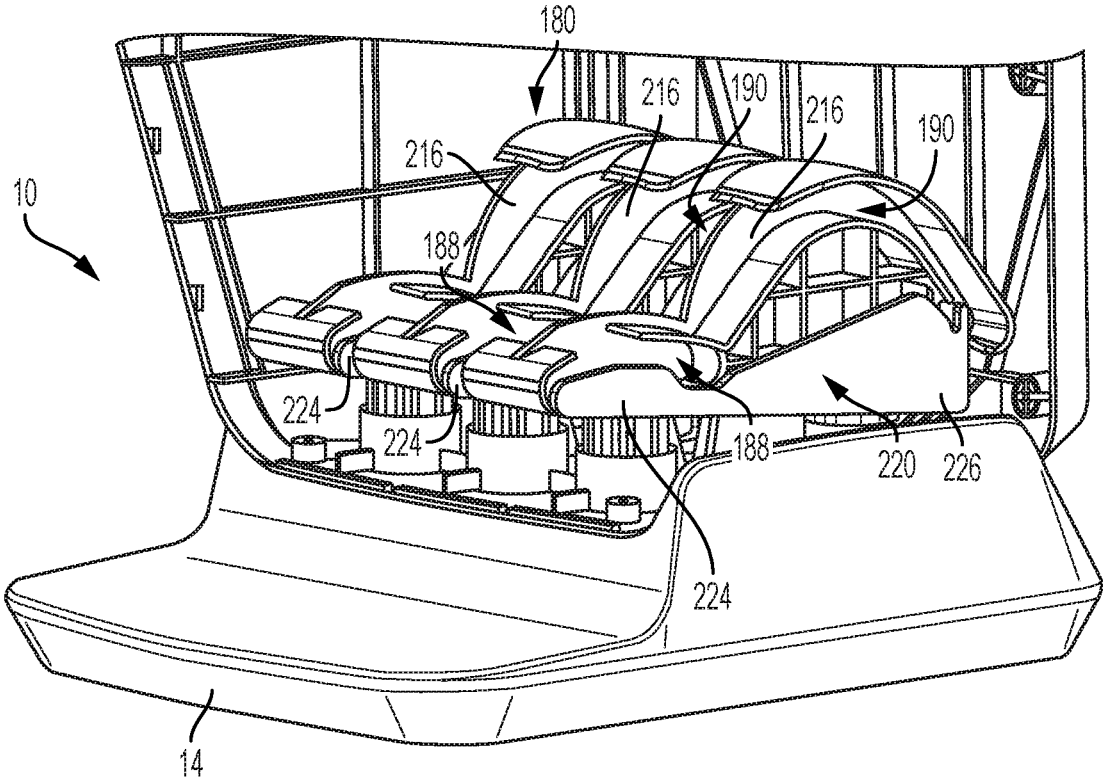
FIG. 22 depicts a partial cut away perspective view of the lower portion of the illustrative utensil dispenser with the dispense chassis removed to better illustrate the glide mechanism, according to one or more embodiments.

FIG. 21 depicts a bottom view of the dispense chassis 18. The dispense chassis 18 can include more than one first pin 182 and can include more than one second pin 186. FIG. 22 depicts a partial cut away perspective view of the utensil dispenser 10 with the glide mechanism 180 without dispense chassis 18. The glide mechanism 180 shown in FIG. 22 can support three dispense chassis 18. The glide mechanism 180 can include more than one first slot 188 and second slot 190 for each dispense chassis 18. The first pins 182 can extend inwardly and can have a first pin space 212 between the first pins 182. The second pins 186 can extend inwardly and can have a second pin space 214 between the second pins 186 (FIG. 21). The glide mechanism 180 can include a slot support 216 which can extend between the first slots 188 and between the second slots 190. The slot support 216 can extend into the first pin space 212 and second pin space 214 when the dispense chassis 18 is mounted to the utensil dispenser 10.

The utensil dispenser 10 can include a dispense chassis interlock 220 (FIGS. 19, 20 and 22). The dispense chassis interlock 220 can include one or more interlock arms 222 which can each have a first portion 224 and a second portion 226. The dispense chassis interlock 220 can be pivotally mounted to the body 12 or the glide mechanism 180 and the interlock arms 222 can be connected to move together. When one of the dispense chassis 18 is moved to the loading position 172 (FIG. 18), the dispense chassis interlock 220 can lock the other dispense chassis 18 in the dispensing position 174 to keep the utensil dispenser 10 from tipping forward due to having too much weight in front of the base 14.

When all of the dispense chassis 18 in the body 12 of the utensil dispenser 10 are in the dispensing position 174, the dispense chassis interlock 220 can be in an unlocked position 228 (FIG. 19), and any one of the dispense chassis 18 can be moved to the loading position 172. In the unlocked position 228, the first portion 224 of the interlock arm 222 can be relatively upward and the second portion 226 can be relatively downward and the interlock arm 222 does not interfere with the movement of the dispense chassis 18. When one of the dispense chassis 18 is moved to the loading position 172, the dispense chassis interlock 220 can move to a locked position 230 (FIG. 20) and the other dispense chassis 18 can be locked in the dispensing position 174. In the locked position 230, the first portion 224 of the interlock arm 222 can be pushed relatively downward by the first pin 182 and the second portion 226 can be moved relatively upward and interfere with the movement of the second pin 186 of the remaining dispense chassis 18. Movement of the dispense chassis 18 back to the dispensing position 174 can returns the dispense chassis interlock 220 to the unlocked position 228.

Embodiments of the present disclosure further relate to any one or more of the following paragraphs.

A utensil dispenser for dispensing a plurality of utensils, comprising: a housing; a dispense chassis configured to fit within the housing; at least one post disposed on an outer surface of the dispense chassis; at least one glide mechanism disposed within the housing and configured to engage the dispense chassis post within the housing, the glide mechanism comprising a slot configured to guide the dispense chassis between a dispensing position in which the dispense chassis is configured to dispense utensils from the housing and a loading position in which the dispense chassis is configured to be loaded with utensils.

The apparatus according to the preceding paragraph, wherein the slot comprises an opening configured to receive the post, wherein removing the post from the slot through the opening separates the dispense chassis from the glide mechanism.

The apparatus according to any one or more of the preceding paragraphs, wherein the opening in the slot is positioned in the slot such that the post can only be removed from the slot when the dispense chassis is between the dispensing position and the loading position.

The apparatus according to any one or more of the preceding paragraphs, wherein the dispense chassis comprises a first and second post and the glide mechanism comprises a first and second slot, the first slot configured to engage the first post and the second slot configured to engage the second post.

The apparatus according to any one or more of the preceding paragraphs, wherein the first and second posts of the dispense chassis are roller pins and the first and second slots are configured to engage the first and second posts.

The apparatus according to any one or more of the preceding paragraphs, wherein the first slot comprises a first slot opening and the second slot comprises a second slot opening wherein the first slot opening and the second slot opening are configured such that the first post cannot be removed from the first slot through the first slot opening at the same time as the second post is removed from the second slot through the second slot opening.

The apparatus according to any one or more of the preceding paragraphs, wherein the slot comprises a first end, a second end, and a crown and wherein the crown is configured to bias the post toward either the first end or the second end of the slot.

The apparatus according to any one or more of the preceding paragraphs, wherein the slot crown is configured to hold the dispense chassis in the dispensing position.

The apparatus according to any one or more of the preceding paragraphs, wherein the slot crown is configured to hold the dispense chassis in the loading position.

The apparatus according to any one or more of the preceding paragraphs, wherein the second slot comprises a first end, a second end, and a crown and wherein the crown is configured to bias the second post toward the first end of the second slot or the second end of the second slot.

The apparatus according to any one or more of the preceding paragraphs, wherein the crown of the second slot is configured to hold the dispense chassis in the dispensing position.

The apparatus according to any one or more of the preceding paragraphs, wherein the crown of the second slot is configured to hold the dispense chassis in the loading position.

A utensil dispenser for dispensing a plurality of utensils, comprising: a housing; a dispense chassis configured to fit within the housing; a first and second post wherein the first and second post are disposed on an outer surface of the dispense chassis; at least one glide mechanism disposed within the housing and configured to engage the first and second post within the housing, the glide mechanism comprising: a first slot comprising a first slot first end, a first slot second end, and a first slot crown, wherein the first slot is configured to engage the first post and wherein the first slot crown is configured to bias the first post toward either the first slot first end or the first slot second end; a second slot comprising a second slot first end, a second slot second end, and a second slot crown, wherein the second slot is configured to engage the second post and wherein the second slot crown is configured to bias the second post toward either the second slot first end or the second slot second end; and wherein the first and second slots are configured to guide the dispense chassis between a dispensing position in which the dispense chassis is configured to dispense utensils from the housing and a loading position in which the dispense chassis is configured to be loaded with utensils.

The apparatus according to the preceding paragraph, wherein the first and second slot crowns are configured to hold the dispense chassis in the dispensing position.

The apparatus according to any one or more of the preceding paragraphs, wherein the first and second slot crowns are configured to hold the dispense chassis in the loading position.

The apparatus according to any one or more of the preceding paragraphs, wherein the first slot comprises a first slot opening and the second slot comprises a second slot opening wherein removing the first post from the first slot through the first slot opening and removing the second post from the second slot through the second slot opening separates the dispense chassis from the glide mechanism.

The apparatus according to any one or more of the preceding paragraphs, wherein the first slot opening is positioned in the first slot such that the first post can only be removed from the first slot when the dispense chassis is between the dispensing position and the loading position.

The apparatus according to any one or more of the preceding paragraphs, wherein the first slot opening and the second slot opening are configured such that the first post cannot be removed from the first slot through the first slot opening at the same time as the second post is removed from the second slot through the second slot opening.

The apparatus according to any one or more of the preceding paragraphs, wherein the first and second posts of the dispense chassis are roller pins and the first and second slots are configured to engage the first and second posts.

A utensil dispenser configured to dispense at least two utensils comprising at least two dispense chassis, each dispense chassis comprising: a housing configured to contain a stack of the utensils therein, wherein the stack of the utensils comprises at least one utensil in addition to a next utensil to be dispensed from the housing; at least one generally vertical support rail disposed within the housing, the generally vertical support rail configured to receive a first portion of each utensil, the first portion having a contoured projection extending outwardly from each utensil to maintain the stack of the utensils in a stacked orientation; a front pedestal disposed inside the housing and beneath the generally vertical support rail, the front pedestal configured to contact the first portion of the next utensil; and a rear pedestal disposed inside the housing and configured to contact a second portion of the next utensil; a drive mechanism configured to contact the next utensil and not contact the other utensils; an access port providing an opening to the housing; an actuator that is operably connected to the drive mechanism and configured to move the drive mechanism into a release position such that the drive mechanism contacts the next utensil in the stack of the utensils to push the next utensil causing the next utensil to release from the stack of the utensils and become a released utensil, wherein the released utensil falls to a dispense position and is accessible via the access port for removing from the dispenser in the dispense position; a ratchet gear assembly positioned at least partially within the housing and operably connected to the actuator to return the drive mechanism from the release position to a holding position; at least one post disposed on the outer surface of the dispense chassis; and at least one glide mechanism disposed within the housing and configured to engage the post within the housing, the glide mechanism comprising, a slot configured to contact the post to guide the dispense chassis between a dispensing position in which the dispense chassis is configured to dispense utensils from the housing and a loading position in which the dispense chassis is configured to be loaded with utensils.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A utensil dispenser for dispensing a plurality of utensils, comprising:

a housing;

a dispense chassis configured to fit within the housing;

at least one post disposed on an outer surface of the dispense chassis;

at least one glide mechanism disposed within the housing and configured to engage the dispense chassis post within the housing, the glide mechanism comprising a slot configured to guide the dispense chassis between a dispensing position in which the dispense chassis is configured to dispense utensils from the housing and a loading position in which the dispense chassis is configured to be loaded with utensils, wherein the slot comprises an elevated portion located between the dispensing and loading positions.

2. The utensil dispenser of claim 1, wherein the dispense chassis comprises a first and second post and the glide mechanism comprises a first and second slot each having an opening formed therethrough, wherein the first post passes through the opening formed in the first slot and the second post passes through the opening formed in the second slot.

3. The utensil dispenser of claim 1, wherein the slot comprises an opening configured to receive the post, wherein removing the post from the slot through the opening separates the dispense chassis from the glide mechanism.

4. The utensil dispenser of claim 3, wherein the opening in the slot is positioned in the slot such that the post can only be removed from the slot when the dispense chassis is between the dispensing position and the loading position.

5. The utensil dispenser of claim 1, wherein the dispense chassis comprises a first and second post and the glide mechanism comprises a first and second slot, the first slot configured to engage the first post and the second slot configured to engage the second post.

6. The utensil dispenser of claim 5, wherein the first slot comprises a first slot opening and the second slot comprises a second slot opening wherein the first slot opening and the second slot opening are configured such that the first post cannot be removed from the first slot through the first slot opening at the same time as the second post is removed from the second slot through the second slot opening.

7. The utensil dispenser of claim 1, wherein the slot comprises a first end, a second end, and a crown wherein the crown is located on the elevation portion of the slot and is configured to bias the post toward either the first end or the second end of the slot.

8. The utensil dispenser of claim 7, wherein the slot crown is configured to hold the dispense chassis in the dispensing position.

9. The utensil dispenser of claim 7, wherein the slot crown is configured to hold the dispense chassis in the loading position.

10. The utensil dispenser of claim 5, wherein the second slot comprises a first end, a second end, and a crown wherein the crown is located on the elevation portion of the slot and is configured to bias the second post toward the first end of the second slot or the second end of the second slot.

11. The utensil dispenser of claim 10, wherein the crown of the second slot is configured to hold the dispense chassis in the dispensing position.

12. The utensil dispenser of claim 10, wherein the crown of the second slot is configured to hold the dispense chassis in the loading position.

13. A utensil dispenser for dispensing a plurality of utensils, comprising:

a housing;

a dispense chassis configured to fit within the housing;

a first and second post wherein the first and second post are disposed on an outer surface of the dispense chassis;

at least one glide mechanism disposed within the housing and configured to engage the first and second post within the housing, the glide mechanism comprising:

a first slot comprising a first slot first end, a first slot second end, and a first slot crown, wherein the first slot is configured to engage the first post and wherein the first slot crown is configured to bias the first post toward either the first slot first end or the first slot second end;

a second slot comprising a second slot first end, a second slot second end, and a second slot crown, wherein the second slot is configured to engage the second post and wherein the second slot crown is configured to bias the second post toward either the second slot first end or the second slot second end; and wherein the first and second slots are configured to guide the dispense chassis between a dispensing position in which the dispense chassis is configured to dispense utensils from the housing and a loading position in which the dispense chassis is configured to be loaded with utensils.

14. The utensil dispenser of claim 13, wherein the first and second slots are configured to engage the first and second posts.

15. The utensil dispenser of claim 13, wherein the first and second slot crowns are configured to hold the dispense chassis in the dispensing position.

16. The utensil dispenser of claim 13, wherein the first and second slot crowns are configured to hold the dispense chassis in the loading position.

17. The utensil dispenser of claim 13, wherein the first slot comprises a first slot opening and the second slot comprises a second slot opening wherein removing the first post from the first slot through the first slot opening and removing the second post from the second slot through the second slot opening separates the dispense chassis from the glide mechanism.

18. The utensil dispenser of claim 17, wherein the first slot opening is positioned in the first slot such that the first post can only be removed from the first slot when the dispense chassis is between the dispensing position and the loading position.

19. The utensil dispenser of claim 18, wherein the first slot opening and the second slot opening are configured such that the first post cannot be removed from the first slot through the first slot opening at the same time as the second post is removed from the second slot through the second slot opening.

20. A utensil dispenser configured to dispense at least two utensils comprising:

at least two dispense chassis, each dispense chassis comprising:

a housing configured to contain a stack of the utensils therein, wherein the stack of the utensils comprises at least one utensil in addition to a next utensil;

at least one generally vertical support rail disposed within the housing, the generally vertical support rail configured to receive a first portion of each utensil, the first portion having a contoured projection extending outwardly from each utensil to maintain the stack of the utensils in a stacked orientation;

a front pedestal disposed inside the housing and beneath the generally vertical support rail, the front pedestal configured to contact the first portion of the next utensil; and a rear pedestal disposed inside the housing and configured to contact a second portion of the next utensil;

a drive mechanism configured to contact the next utensil;

an access port providing an opening to the housing;

an actuator that is operably connected to the drive mechanism and configured to move the drive mechanism into a release position such that the drive mechanism contacts the next utensil in the stack of the utensils to push the next utensil causing the next utensil to release from the stack of the utensils and become a released utensil, wherein the released utensil falls to a dispense position and is accessible via the access port for removing from the dispenser in the dispense position;

a ratchet gear assembly positioned at least partially within the housing and operably connected to the actuator to return the drive mechanism from the release position to a holding position;

at least one post disposed on the outer surface of the dispense chassis; and at least one glide mechanism disposed within the housing and configured to engage the post within the housing, the glide mechanism comprising a slot configured to guide the dispense chassis between a dispensing position in which the dispense chassis is configured to dispense utensils from the housing and a loading position in which the dispense chassis is configured to be loaded with utensils.

* * * * *